US012584486B2

(12) United States Patent
Inoue et al.

(10) Patent No.: US 12,584,486 B2
(45) Date of Patent: Mar. 24, 2026

(54) CENTRIFUGAL FAN

(71) Applicant: DENSO CORPORATION, Kariya-city (JP)

(72) Inventors: Ryosuke Inoue, Kariya-city (JP); Jun Yamaoka, Kariya-city (JP)

(73) Assignee: DENSO CORPORATION, Kariya-city (JP)

( * ) Notice: Subject to any disclaimer, the term of this patent is extended or adjusted under 35 U.S.C. 154(b) by 0 days.

(21) Appl. No.: 18/810,890

(22) Filed: Aug. 21, 2024

(65) Prior Publication Data

US 2024/0410375 A1 Dec. 12, 2024

Related U.S. Application Data

(63) Continuation of application No. PCT/JP2023/011994, filed on Mar. 24, 2023.

(30) Foreign Application Priority Data

Apr. 12, 2022 (JP) ..... 2022-065872

(51) Int. Cl.
*F04D 17/08* (2006.01)
*F04D 29/28* (2006.01)
(Continued)

(52) U.S. Cl.
CPC ..... *F04D 17/08* (2013.01); *F04D 29/4226* (2013.01)

(58) Field of Classification Search
CPC ..... F04D 29/281; F04D 29/30; F04D 17/10; F04D 29/162; F04D 19/002; F04D 17/16; F04D 29/28; F04D 29/44; F04D 29/4226; F04D 17/08; F04D 29/38; F04D 29/386; F05D 2240/304; F05D 2240/301; F05D 2240/305; F05D 2240/306; F05D 2240/303; F05D 2250/183; F05D 2250/61;
(Continued)

(56) References Cited

U.S. PATENT DOCUMENTS 8,784,060 B2 * 7/2014 Iwata ..... F04D 29/282 416/185
9,995,311 B2 * 6/2018 Son ..... B21D 11/20
(Continued)

FOREIGN PATENT DOCUMENTS

EP 2264320 A1 12/2010
EP 2264320 B1 * 8/2018 ..... F24F 1/0038
(Continued)

*Primary Examiner* — Eric J Zamora Alvarez
(74) *Attorney, Agent, or Firm* — Harness, Dickey & Pierce, P.L.C.

(57) ABSTRACT

In a centrifugal fan, a tangent line, which is tangent to a positive pressure surface of a blade and passes through a trailing edge of the blade, is defined as a first tangent line. A virtual circle is centered on a rotational axis and passes through the trailing edge. A tangent line, which is tangent to the virtual circle and passes through the trailing edge, is defined as a second tangent line. An angle, which is placed in front of the first tangent line in a rotational direction and is on an outer side of the virtual circle relative to the second tangent line, is defined as an outlet angle. When a change in the outlet angle is viewed at each of a plurality of locations along the trailing edge, the trailing edge has at least one inflection point.

12 Claims, 17 Drawing Sheets

(51) Int. Cl.
*F04D 29/30* (2006.01)
*F04D 29/42* (2006.01)

(58) Field of Classification Search
CPC ..... F05D 2250/611; F05D 2260/961; F01D 5/04; F01D 5/145
See application file for complete search history.

(56) References Cited

U.S. PATENT DOCUMENTS

| | | | | |
|---|---|---|---|---|
| 11,674,520 | B2 * | 6/2023 | Takeishi | F04D 29/30 415/177 |
| 2012/0121422 | A1 * | 5/2012 | Kim | F04D 29/281 416/185 |
| 2015/0275922 | A1 * | 10/2015 | Son | B21D 11/20 415/206 |
| 2015/0308452 | A1 * | 10/2015 | Son | B23K 26/32 416/182 |

FOREIGN PATENT DOCUMENTS

| | | | |
|---|---|---|---|
| JP | 2007170771 | A | 7/2007 |
| JP | 2009281215 | A | 12/2009 |
| JP | 2011064072 | A | 3/2011 |
| JP | 6981077 | B2 | 12/2021 |
| WO | WO-2009128299 | A1 | 10/2009 |

* cited by examiner

CENTRIFUGAL FAN

CROSS REFERENCE TO RELATED APPLICATIONS

This application is a continuation application of International Patent Application No. PCT/JP2023/011994 filed on Mar. 24, 2023, which designated the U.S. and claims the benefit of priority from Japanese Patent Application No. 2022-065872 filed on Apr. 12, 2022. The entire disclosures of all of the above applications are incorporated herein by reference.

TECHNICAL FIELD

The present disclosure relates to a centrifugal fan.

BACKGROUND

A centrifugal fan, which is used in a blower, has been previously proposed. In the previously proposed centrifugal fan, a skew angle of a trailing edge of a blade is smaller than a skew angle of a leading edge of the blade. With this configuration, this centrifugal fan reduces noise and improves pressure boosting characteristics by limiting a secondary flow vortex generated in the airflow flowing in a flow passage formed between corresponding adjacent two blades which are adjacent to each other in a rotational direction. The skew angle is an angle defined between a main plate and a line, which connects between a portion of the blade joined to the main plate and a portion of the blade joined to a shroud, at a negative pressure surface side of the blade.

SUMMARY

This section provides a general summary of the disclosure, and is not a comprehensive disclosure of its full scope or all of its features.

According to one aspect of the present disclosure, a centrifugal fan includes a shroud, a main plate and a plurality of blades. The plurality of blades are arranged at predetermined intervals in a rotational direction between the shroud and the main plate and are joined to the shroud and the main plate. A tangent line, which is tangent to a positive pressure surface of a predetermined blade among the plurality of blades and passes through a trailing edge of the predetermined blade, is defined as a first tangent line. A virtual circle is centered on a rotational axis and passes through the trailing edge of the predetermined blade, and a tangent line, which is tangent to the virtual circle and passes through the trailing edge of the predetermined blade, is defined as a second tangent line. Among a plurality of angles defined between the first tangent line and the second tangent line, an angle, which is placed in front of the first tangent line in the rotational direction and is on an outer side of the virtual circle relative to the second tangent line, is defined as an outlet angle. When a change in the outlet angle is viewed at each of a plurality of locations axially arranged along the trailing edge, the trailing edge has at least one inflection point where an increase or decrease in the outlet angle is changed.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
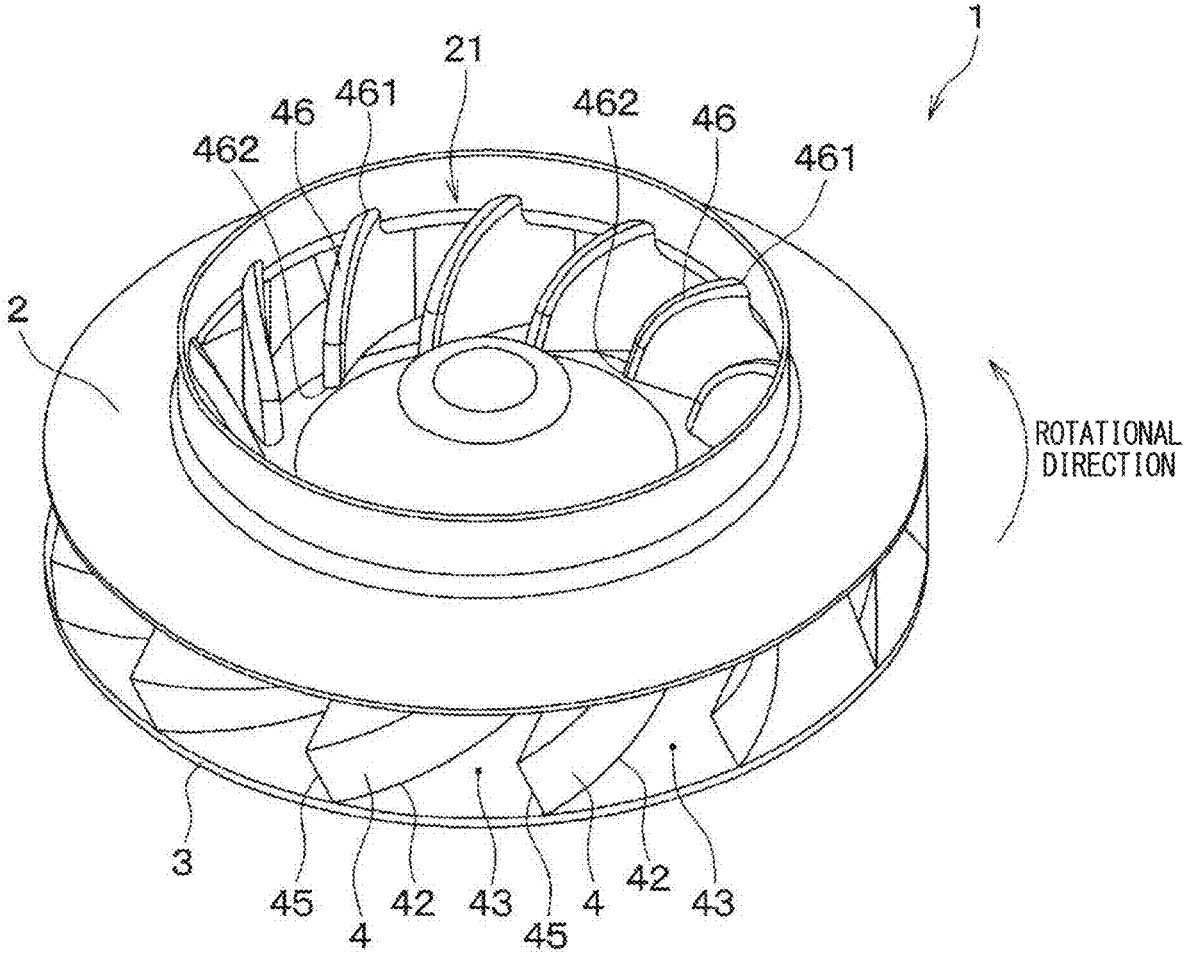
FIG. 1 is s perspective view of a centrifugal fan of a first embodiment.

A centrifugal fan, which is used in a blower, has been previously proposed. In the previously proposed centrifugal fan, a skew angle of a trailing edge of a blade is smaller than a skew angle of a leading edge of the blade. With this configuration, this centrifugal fan reduces noise and improves pressure boosting characteristics by limiting a secondary flow vortex generated in the airflow flowing in a flow passage (hereinafter, referred to as an inter-blade passage) formed between corresponding adjacent two blades which are adjacent to each other in a rotational direction. The skew angle is an angle defined between a main plate and a line, which connects between a portion of the blade joined to the main plate and a portion of the blade joined to a shroud, at a negative pressure surface side of the blade.

The centrifugal fan used in the blower may possibly have variations in an airflow velocity distribution of the airflow discharged from a blade outlet depending on a shape or a size of each component, such as the shroud, the main plate and the blades. When the variations in the airflow velocity distribution of the airflow discharged from the blade outlet becomes large in the centrifugal fan, the noise is increased, and the air blowing efficiency is deteriorated. Therefore, the previously proposed centrifugal fan has room for further improvement.

According to one aspect of the present disclosure, a centrifugal fan includes a shroud, a main plate and a plurality of blades. The shroud is shaped in a ring form and has an air suction port at a center of the shroud. The main plate is opposed to the shroud and is configured to be rotated together with the shroud. The plurality of blades are arranged at predetermined intervals in a rotational direction between the shroud and the main plate and are joined to the shroud and the main plate. A tangent line, which is tangent to a positive pressure surface of a predetermined blade among the plurality of blades and passes through a trailing edge of the predetermined blade, is defined as a first tangent line. A virtual circle is centered on a rotational axis and passes through the trailing edge of the predetermined blade, and a tangent line, which is tangent to the virtual circle and passes through the trailing edge of the predetermined blade, is defined as a second tangent line. Among a plurality of angles defined between the first tangent line and the second tangent line, an angle, which is placed in front of the first tangent line in the rotational direction and is on an outer side of the virtual circle relative to the second tangent line, is defined as an outlet angle. When a change in the outlet angle is viewed at each of a plurality of locations axially arranged along the trailing edge, the trailing edge has at least one inflection point where an increase or decrease in the outlet angle is changed. At least one of the outlet angle, which is measured at a corresponding adjacent one of the plurality of locations adjacent to the main plate along the trailing edge, and the outlet angle, which is measured at a corresponding adjacent one of the plurality of locations adjacent to the shroud along the trailing edge, is smaller than the outlet angle, which is measured at a corresponding one of the plurality of locations where the outlet angle is the largest among the plurality of locations axially arranged along the trailing edge.

According to the above aspect, there are three possible configurations. The first configuration is that the outlet angle measured at the corresponding adjacent location of the trailing edge adjacent to the main plate and the outlet angle measured at the corresponding adjacent location of the trailing edge adjacent to the shroud are both made relatively small. The second configuration is that the outlet angle measured at the corresponding adjacent location of the trailing edge adjacent to the main plate is made relatively small. The third configuration is that the outlet angle measured at the corresponding adjacent location of the trailing edge adjacent to the shroud is made relatively small.

In the description of the present disclosure, the adjacent location of the trailing edge adjacent to the main plate is defined as a location of the trailing edge that is on the main plate side of the inflection point which is closest to the main plate. Furthermore, the adjacent location of the trailing edge adjacent to the shroud is defined as a location of the trailing edge that is on the shroud side of the inflection point which is closest to the shroud.

The first configuration (i.e., the configuration in which the outlet angle measured at the corresponding adjacent location of the trailing edge adjacent to the main plate and the outlet angle measured at the corresponding adjacent location of the trailing edge adjacent to the shroud are both made relatively small) is effective in a case where the airflow velocity in the shroud side region and the airflow velocity in the main plate side region at the blade outlet are both low, and the airflow velocity in an axial center region of the blade outlet is high in a hypothetical structure where the trailing edge is formed parallel to the rotational axis. The airflow velocity in the main plate side region of the blade outlet may possibly become low due to an influence of a boundary layer generated by, for example, friction between the airflow and the main plate. Furthermore, the airflow velocity in the shroud side region of the blade outlet may possibly become low due to an influence of, for example, a vortex generated near the shroud in the inter-blade passage. In such a case, when the outlet angle, which is measured at the corresponding adjacent location of the trailing edge adjacent to the shroud, and the outlet angle, which is measured at the corresponding adjacent location of the trailing edge adjacent to the main plate, are both made relatively small, the airflow velocity in these regions are accelerated in comparison to the other regions at the trailing edge. In addition to this, by increasing the outlet angle, which is measured at a location of the axial center portion of the trailing edge, the airflow velocity at the region of the axial center portion can be decelerated in comparison to the other regions at the trailing edge. Therefore, with the centrifugal fan described above, the airflow velocity distribution of the airflow discharged from the blade outlet can be made closer to uniform, and thereby it is possible to reduce the noise and improve the air blowing efficiency.

The second configuration (i.e., the configuration in which the outlet angle measured at the corresponding adjacent location of the trailing edge adjacent to the main plate is made relatively small) is effective in a case where the airflow velocity in the main plate side region of the blade outlet is low in the hypothetical structure where the trailing edge is formed parallel to the rotational axis. In such a case, when the outlet angle, which is measured at the corresponding adjacent location of the trailing edge adjacent to the main plate, is made relatively small, the amount of work applied from the main plate side portion of the blade to the airflow is increased, and thereby the airflow velocity in the main plate side region is accelerated in comparison to the other regions at the trailing edge. Therefore, with the centrifugal fan described above, the airflow velocity distribution of the airflow discharged from the blade outlet can be made closer to uniform, and thereby it is possible to reduce the noise and improve the air blowing efficiency.

The third configuration (i.e., the configuration in which the outlet angle measured at the corresponding adjacent location of the trailing edge adjacent to the shroud is made relatively small) is effective in a case where the airflow velocity in the shroud side region of the blade outlet is low in the hypothetical structure where the trailing edge is formed parallel to the rotational axis. In such a case, when the outlet angle, which is measured at the corresponding adjacent location of the trailing edge adjacent to the shroud, is made relatively small, the amount of work applied from the shroud side region of the blade to the airflow is increased, and thereby the airflow velocity in the shroud side region is accelerated in comparison to the other regions at the trailing edge. Therefore, with the centrifugal fan described above, the airflow velocity distribution of the airflow discharged from the blade outlet can be made closer to uniform, and thereby it is possible to reduce the noise and improve the air blowing efficiency.

Hereinafter, embodiments of the present disclosure will be described with reference to the drawings. In each of the following embodiments, portions, which are the same or equivalent to each other, will be indicated by the same reference signs. With respect to the drawings referenced in the respective embodiments, a shape of each component, a size of each component, the number of blades, and a thickness of each blade in a centrifugal fan are described schematically for the sake of clarity of explanation and do not limit the present disclosure.

First Embodiment

A first embodiment will be described with reference to the drawings. A centrifugal fan of the first embodiment is used in a blower of, for example, an air conditioning apparatus or a ventilating apparatus.

Figure 2:
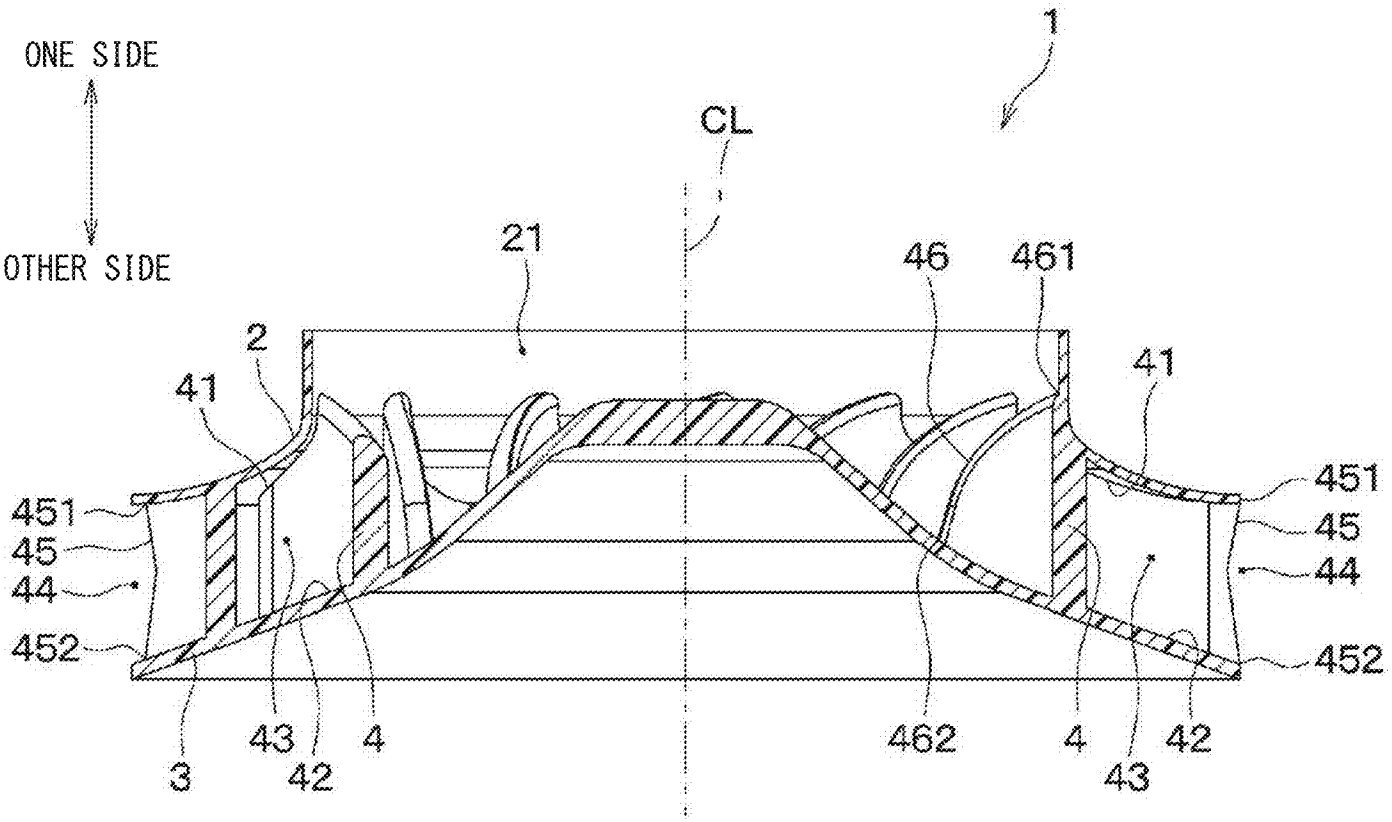
FIG. 2 is a cross-sectional view of the centrifugal fan of the first embodiment taken along a plane parallel to a rotational axis.
Figure 3:
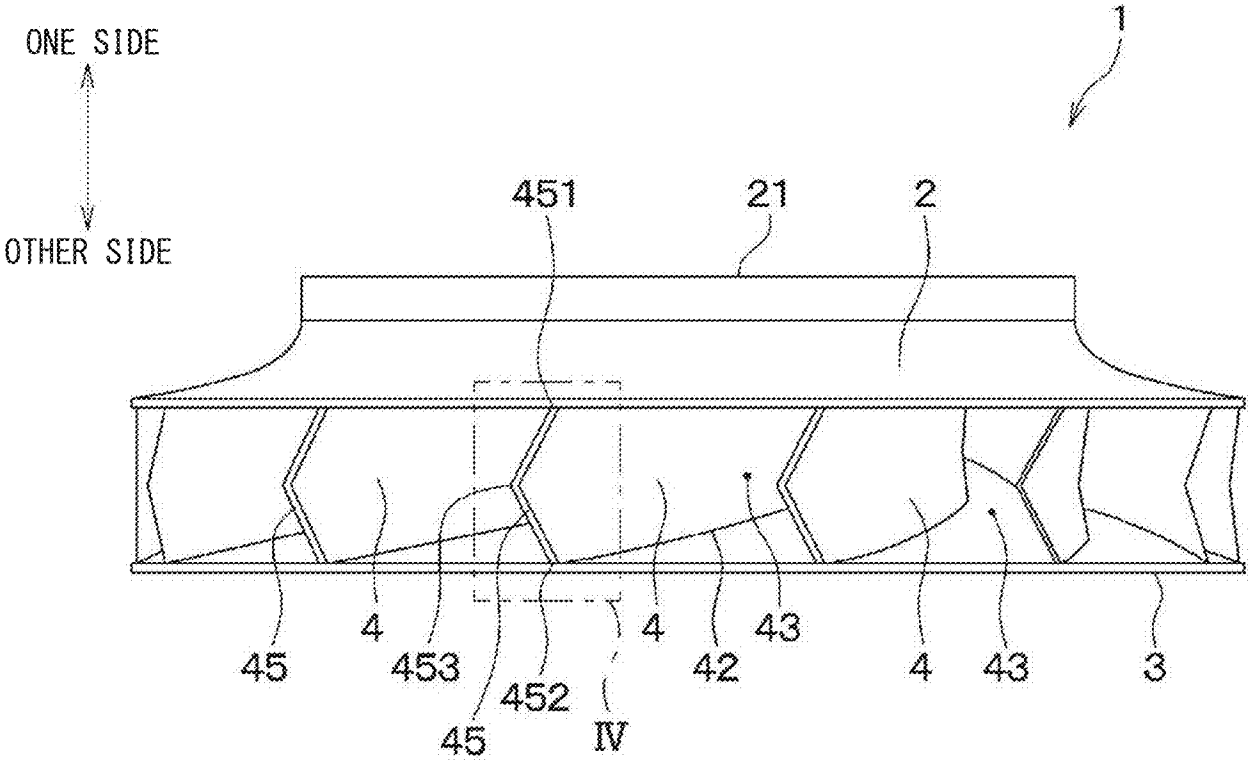
FIG. 3 is a side view of the centrifugal fan of the first embodiment.

As shown in FIGS. 1 to 3, the centrifugal fan 1 includes: a shroud 2 which has an air suction port; a main plate 3 which is opposed to the shroud 2; and a plurality of blades 4 which are arranged between the shroud 2 and the main plate 3. In FIG. 2, a rotational axis CL of the centrifugal fan 1 is indicated by a dot-dash line. Hereinafter, an extending direction of the rotational axis CL will be referred to as an axial direction. A radially outer side of a circle, which is perpendicular to the rotational axis CL and is centered on the rotational axis CL, will be referred to as a radially outer side or simply an outer side. The air suction port 21 side of the shroud 2 in the axial direction will be referred to as one side in the axial direction, and the opposite side, which is opposite to the one side, will be referred to as the other side in the axial direction.

The shroud 2 is shaped in a ring form and has the air suction port 21 which is configured to suction the air and is formed at a center of the shroud 2. The shroud 2 is shaped such that the shroud 2 progressively approaches the other axial side as the shroud 2 extends from the air suction port 21 toward the radially outer side.

The main plate 3 is shaped in a circular disk form and progressively approaches the other axial side as the main plate 3 extends from the center portion toward the radially outer side. In other words, the main plate 3 is formed such that the center portion of the main plate 3 projects toward the air suction port 21. A shaft of an electric motor (not shown) is installed to the center portion of the main plate 3.

The blades 4 are arranged at predetermined intervals in a rotational direction of the centrifugal fan 1 between the main plate 3 and the shroud 2. A portion 41 of each blade 4, which is placed on the one side in the axial direction, is joined to the shroud 2, and a portion 42 of each blade 4, which is placed on the other side in the axial direction, is joined to the main plate 3. That is, the blades 4, the shroud 2 and the main plate 3 are formed integrally in one-piece. Each of the blades 4 is arranged such that a trailing edge 45 of the blade 4 is placed behind (i.e., on a backward side of) a virtual plane that includes the rotational axis CL and a leading edge 46 of the blade 4 in the rotational direction. Therefore, the centrifugal fan 1 is a turbofan.

The centrifugal fan 1 (i.e., the main plate 3, the shroud 2 and the blades 4) is rotated by the electric motor (not shown) in the rotational direction indicated by an arrow in, for example, FIG. 1. When the centrifugal fan 1 is rotated, the air, which is suctioned from the air suction port 21, flows from the leading edge 46 of the corresponding blade 4 through a corresponding inter-blade passage 43 formed between corresponding adjacent two of the blades 4 and is radially outwardly discharged from a corresponding blade outlet 44 formed by the trailing edge 45 of the corresponding blade 4, the shroud 2 and the main plate 3.

Figure 4:
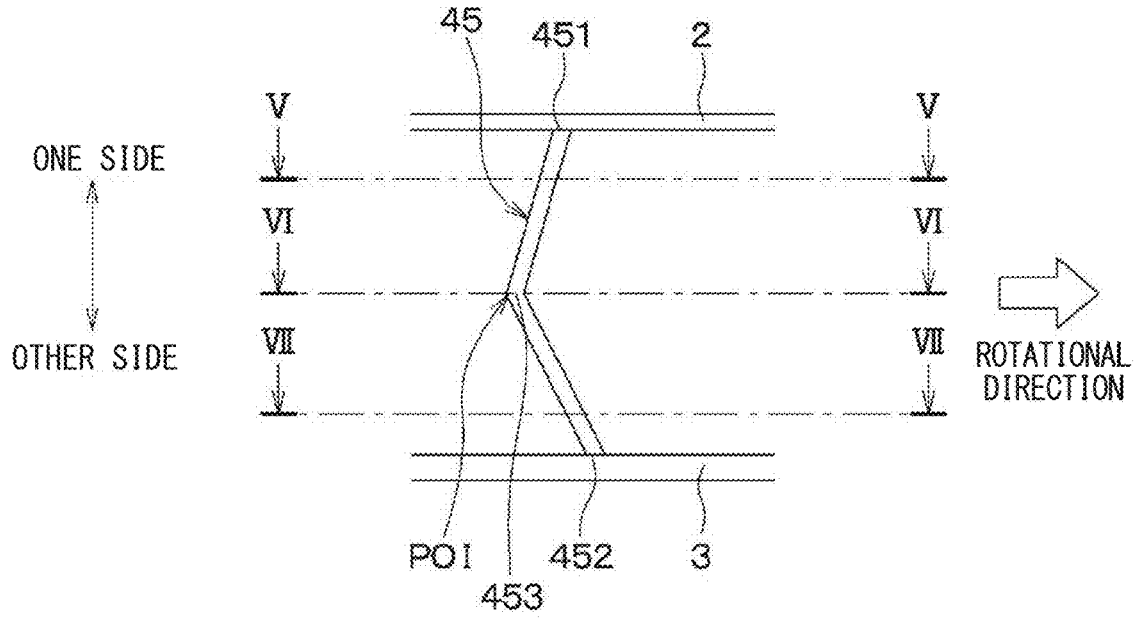
FIG. 4 is an enlarged view of a portion IV in FIG. 3.

As shown in FIGS. 3 and 4, in the first embodiment, an axial center portion 453 of the trailing edge 45 of the blade 4, which is centered in the axial direction, is placed behind a portion (joined portion) 451 of the trailing edge 45 joined to the shroud 2 and a portion (joined portion) 452 of the trailing edge 45 joined to the main plate 3 in the rotational direction.

In contrast, as shown in FIGS. 1 and 2, the leading edge 46 of the blade 4 extends generally parallel to the rotational axis CL from a portion 461 of the leading edge 46 joined to the shroud 2 to a portion 462 of the leading edge 46 joined to the main plate 3. Therefore, in the centrifugal fan 1, the axial center portion of each blade 4, which is centered in the axial direction, is progressively displaced toward the backward side in the rotational direction from a predetermined position, which is in the middle of the blade 4 between the leading edge 46 and the trailing edge 45, to the trailing edge 45 relative to the portion 41 joined to the shroud 2 and the portion 42 joined to the main plate 3.

Figure 5:
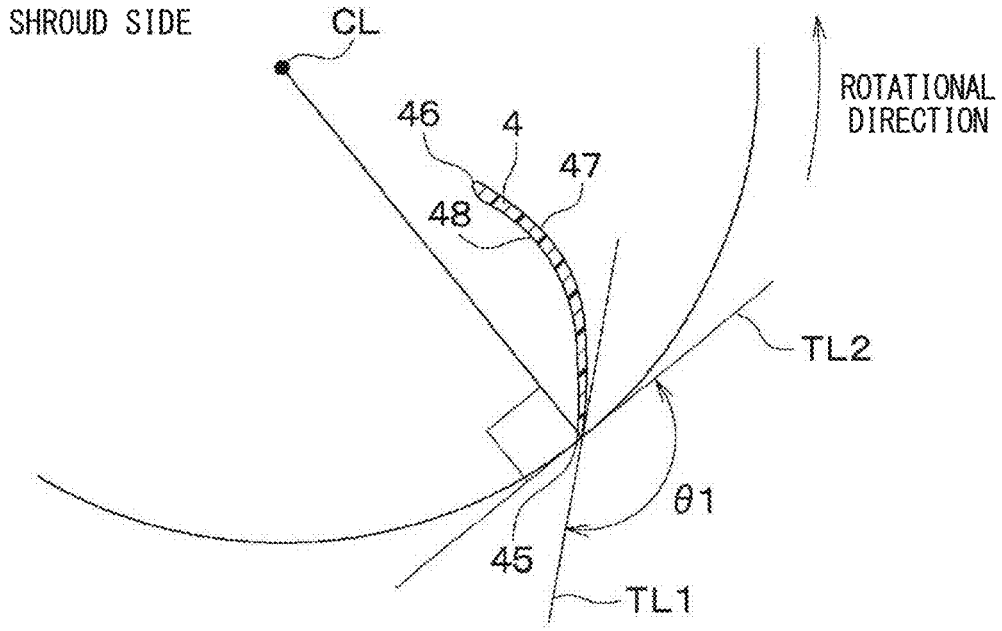
FIG. 5 is a cross-sectional view taken along line V-V in FIG. 4 for explaining a positive pressure surface side outlet angle that is measured at an adjacent location which is adjacent to a shroud.
Figure 6:
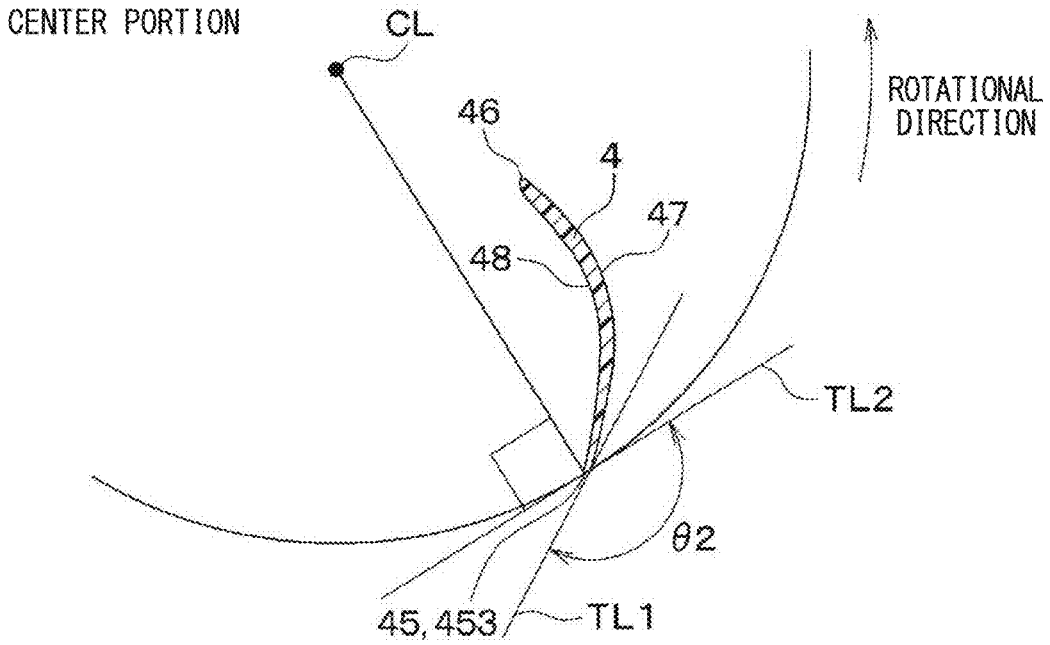
FIG. 6 is a cross-sectional view taken along line VI-VI in FIG. 4 for explaining a positive pressure surface side outlet angle that is measured at a location of an axial center portion which is centered in an axial direction.

Now, an outlet angle at the trailing edge 45 of the blade 4 will be described with reference to FIGS. 5 to 7. FIG. 5 is a cross-sectional view taken along line V-V in FIG. 4, i.e., a cross-sectional view of the blade 4 at the adjacent location which is adjacent to the shroud 2. FIG. 6 is a cross-sectional view taken along line VI-VI in FIG. 4, i.e., a cross-sectional view of the axial center portion of the blade 4 which is centered in the axial direction. Furthermore, FIG. 7 is a cross-sectional view taken along line VII-VII in FIG. 4, i.e., a cross-sectional view of the blade 4 at the adjacent location which is adjacent to the main plate 3.

Figure 7:
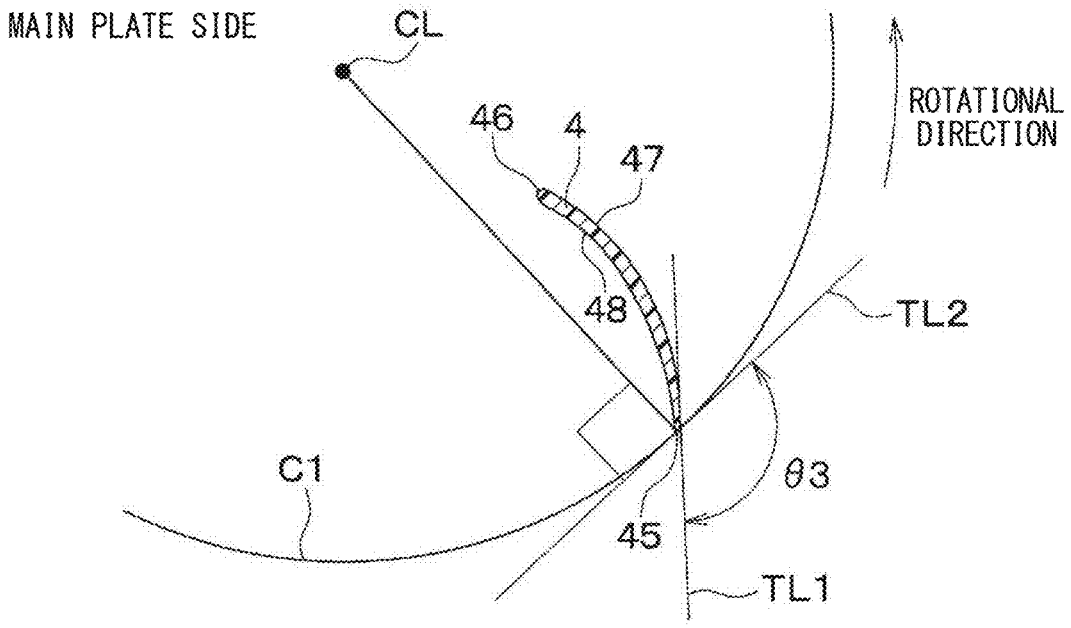
FIG. 7 is a cross-sectional view taken along line VII-VII in FIG. 4 for explaining a positive pressure surface side outlet angle that is measured at an adjacent location which is adjacent to a main plate.

As shown in FIGS. 5 to 7, in the following description, a tangent line, which is tangent to a positive pressure surface 47 of a predetermined blade 4 among the plurality of blades 4 and passes through the trailing edge 45 of the blade 4, is defined as a first tangent line TL1. Furthermore, a virtual circle (hereinafter, referred to as a first virtual circle C1) is centered on the rotational axis CL and passes through the trailing edge 45 of the predetermined blade 4. A tangent line, which is tangent to the first virtual circle C1 and passes through the trailing edge 45 of the blade 4, is defined as a second tangent line TL2. Among a plurality of angles defined between the first tangent line TL1 and the second tangent line TL2, an angle, which is placed in front of (i.e., on a forward side of) the first tangent line TL1 in the rotational direction and is on an outer side of the first virtual circle C1 relative to the second tangent line TL2, is defined as a positive pressure surface side outlet angle. In the following description, the positive pressure surface side outlet angle will be also simply referred to as an outlet angle.

In FIG. 5, the outlet angle, which is measured at the adjacent location of the trailing edge 45 adjacent to the shroud 2, is indicated by θ1. In FIG. 6, the outlet angle, which is measured at the location of the axial center portion 453 of the trailing edge 45, is indicated by θ2. In FIG. 7, the outlet angle, which is measured at the adjacent location of the trailing edge 45 adjacent to the main plate 3, is indicated by θ3. As described above, in the centrifugal fan 1 of the first embodiment, the outlet angle θ3, which is measured at the adjacent location of the trailing edge 45 adjacent to the main plate 3, and the outlet angle θ1, which is measured at the adjacent location of the trailing edge 45 adjacent to the shroud 2, are both smaller than the outlet angle θ2 which is measured at the location of the axial center portion 453 of the trailing edge 45. The location of the axial center portion 453 of the trailing edge 45 can be said to be a location where the outlet angle is the largest among the plurality of locations axially arranged along the trailing edge 45. Furthermore, as shown in FIG. 4, the centrifugal fan 1 of the first embodiment is configured such that when a change in the outlet angle is viewed at each of the plurality of locations axially arranged along the trailing edge 45, the trailing edge 45 has at least one inflection point POI where an increase or decrease in the outlet angle is changed. In the first embodiment, the inflection point POI is located at the location of the axial center portion 453 of the trailing edge 45.

The centrifugal fan 1 of the first embodiment is configured to have the at least one inflection point POI at the trailing edge 45 of each blade 4. Furthermore, this centrifugal fan 1 is configured such that the outlet angle θ3, which is measured at the adjacent location of the trailing edge 45 adjacent to the main plate 3, and the outlet angle θ1, which is measured at the adjacent location of the trailing edge 45 adjacent to the shroud 2, are both smaller than the outlet angle θ2 which is measured at the location of the axial center portion 453 of the trailing edge 45. The significance of the above configuration of the centrifugal fan 1 of the present embodiment will be described hereinafter.

Figure 8:
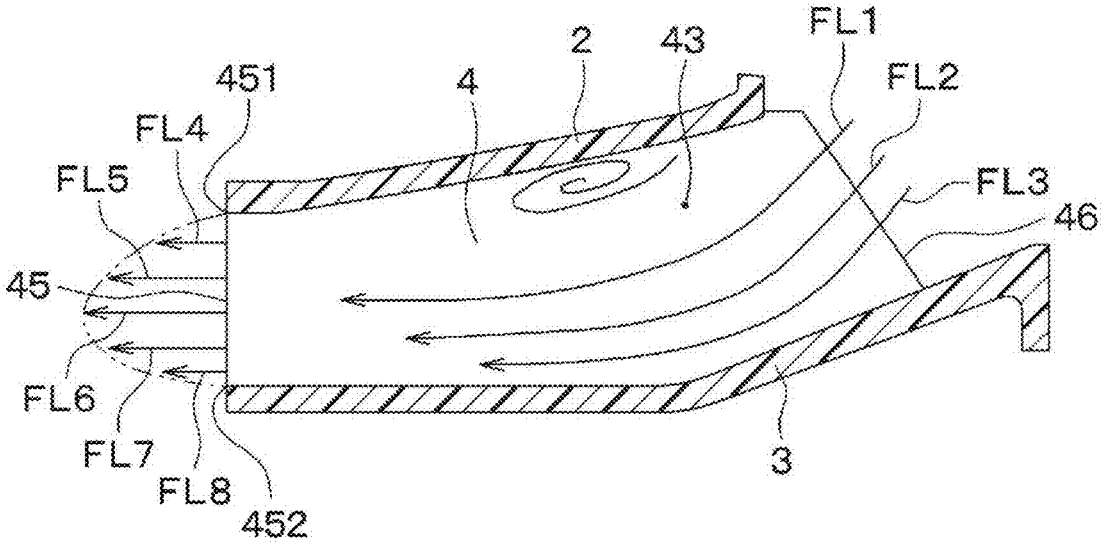
FIG. 8 is a diagram showing a blade of a centrifugal fan of a comparative example seen in a rotational direction for explaining an airflow velocity of an airflow at an inter-blade passage and an airflow velocity of the airflow discharged from a blade outlet.
Figure 9:
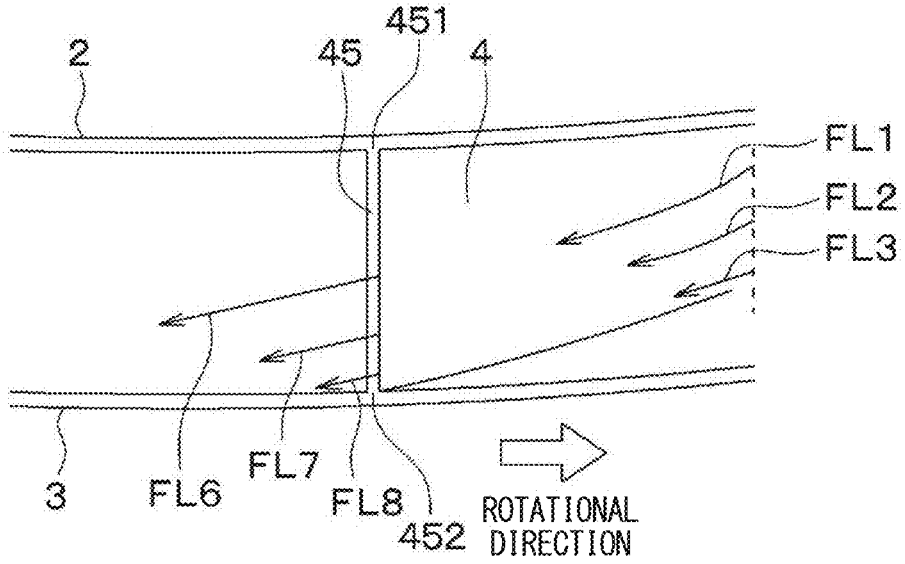
FIG. 9 is a side view of the centrifugal fan of the comparative example for explaining the airflow velocity of the airflow at the inter-blade passage and the airflow velocity of the airflow discharged from the blade outlet.

FIGS. 8 and 9 indicate a centrifugal fan of a comparative example (hypothetical example) which is different from the first embodiment.

As shown in FIG. 9, each of the blades 4 of the centrifugal fan of the comparative example is formed such that the trailing edge 45 of the blade 4 extends generally parallel to the rotational axis CL from the portion 451 of the trailing edge 45 joined to the shroud 2 to the portion 452 of the trailing edge 45 joined to the main plate 3. Therefore, the outlet angle of the trailing edge 45 of the blade 4 is constant from the shroud 2 side to the main plate 3 side.

In FIGS. 8 and 9, a magnitude of the airflow velocity of the airflow flowing at the inter-blade passage 43 and a magnitude of the airflow velocity of the airflow discharged from the blade outlet 44 are indicated by a length of each corresponding arrow.

In the centrifugal fan of the comparative example, as indicated by arrows FL1, FL2, FL3 in FIGS. 8 and 9, the airflow, which is axially suctioned into the air suction port 21 of the shroud 2, changes its flow direction along the main plate 3 and then flows from the leading edge 46 of the blade 4 into the inter-blade passage 43. Furthermore, in the inter-blade passage 43, the airflow is detached from the shroud 2, and thereby a main airflow is biased toward the main plate 3 side. Due to the factors described above, in the inter-blade passage 43, the airflow velocity is higher in an axial center region and a region on the main plate 3 side of the axial center region in comparison to the airflow velocity in the region adjacent to the shroud 2. However, as indicated by the arrow FL3, the airflow velocity is reduced in the region adjacent to the main plate 3 due to an influence of a boundary layer generated by, for example, friction between the airflow and the main plate 3.

Therefore, in the centrifugal fan of the comparative example, as indicated by arrows FL4 to FL8 and a dot-dot-dash line, variations occur in the airflow velocity distribution of the airflow discharged from the blade outlet 44. Thus, the noise may possibly be increased, and the pressure boosting characteristics may possibly be deteriorated.

Figure 10:
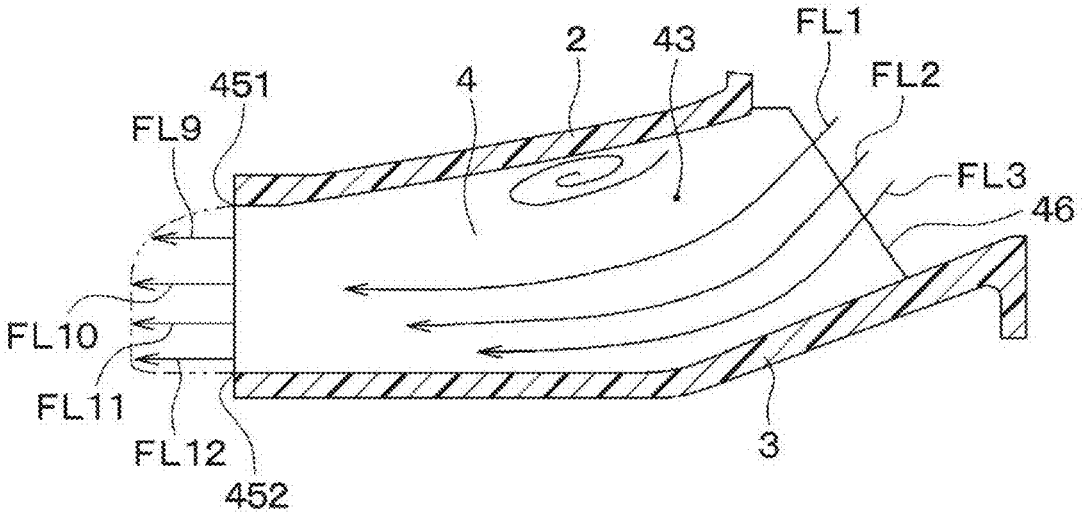
FIG. 10 is a view of the centrifugal fan of the first embodiment seen in the rotational direction for explaining an airflow velocity of an airflow at an inter-blade passage and an airflow velocity of the airflow discharged from a blade outlet.
Figure 11:
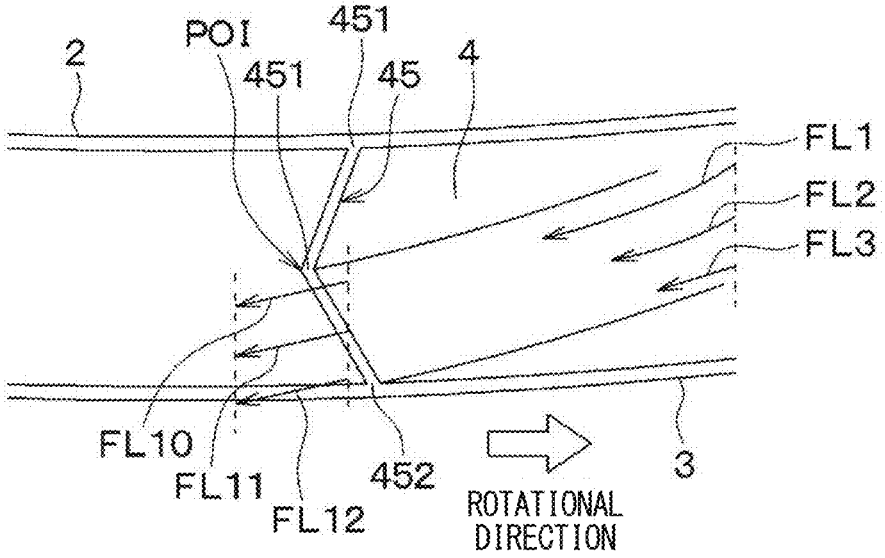
FIG. 11 is a side view of the centrifugal fan of the first embodiment for explaining the airflow velocity of the airflow at the inter-blade passage and the airflow velocity of the airflow discharged from the blade outlet.

In contrast, FIGS. 10 and 11 indicate the centrifugal fan 1 of the first embodiment. In FIGS. 10 and 11, a magnitude of the airflow velocity of the airflow flowing at the inter-blade passage 43 and a magnitude of the airflow velocity of the airflow discharged from the blade outlet 44 are also indicated by a length of each corresponding arrow.

The blades 4 of the centrifugal fan 1 of the first embodiment have the above-described configuration. That is, the trailing edge 45 has the at least one inflection point POI, and the outlet angle θ3, which is measured at the adjacent location of the trailing edge 45 adjacent to the main plate 3, and the outlet angle θ1, which is measured at the adjacent location of the trailing edge 45 adjacent to the shroud 2, are both smaller than the outlet angle θ2 which is measured at the location of the axial center portion 453 of the trailing edge 45. In other words, the outlet angle θ2, which is measured at the location of the axial center portion 453 of the trailing edge 45, is larger than the outlet angle θ3, which is measured at the adjacent location of the trailing edge 45 adjacent to the main plate 3, and the outlet angle θ1, which is measured at the adjacent location of the trailing edge 45 adjacent to the shroud 2. By increasing the outlet angle, the force, which is applied from the blade 4 to the airflow flowing in the inter-blade passage 43, tends to be reduced, and thereby the amount of work applied from the blade 4 to the airflow is reduced to reduce the airflow velocity in comparison to the other regions. Therefore, in the first embodiment, as indicated by an arrow FL10 and a dot-dot-dash line, by increasing the outlet angle θ2 measured at the location of the axial center portion 453 of the trailing edge 45, the airflow velocity at the axial center region of the inter-blade passage 43 can be decelerated in comparison to the other regions at the trailing edge 45. Thus, the centrifugal fan 1 of the first embodiment can provide the more uniform airflow velocity distribution of the airflow discharged from the blade outlet 44.

Furthermore, in the centrifugal fan 1 of the first embodiment, the outlet angle θ3 at the adjacent location of the trailing edge 45 adjacent to the main plate 3 is small, as described above. With this configuration, the force is more likely applied from the blade 4 to the airflow in the inter-blade passage 43, and thereby the amount of work applied from the blade 4 to the airflow is increased to increase the airflow velocity in comparison to the other locations. Therefore, in the first embodiment, as indicated by an arrow FL12, by reducing the outlet angle θ3, which is measured at the adjacent location of the trailing edge 45 adjacent to the main plate 3, the airflow velocity, which is relatively low in the region adjacent to the main plate 3 at the inter-blade passage 43, can be accelerated in comparison to the other regions at the trailing edge 45. Thus, the centrifugal fan 1 of the first embodiment can provide the more uniform airflow velocity distribution of the airflow discharged from the blade outlet 44.

Figure 12:
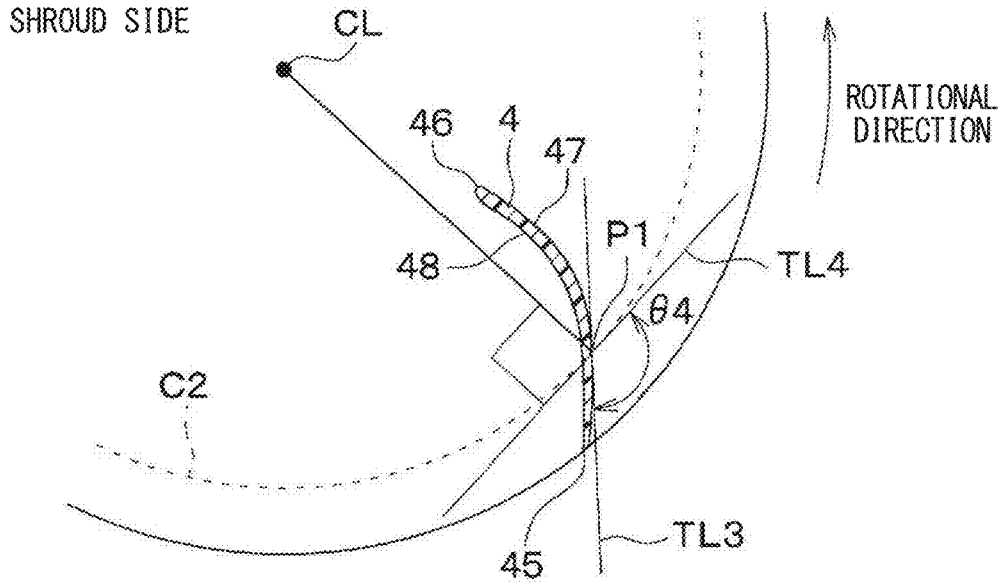
FIG. 12 is a cross-sectional view taken along line V-V in FIG. 4 for explaining a positive pressure surface side blade surface angle that is measured at the adjacent location which is adjacent to the shroud.
Figure 13:
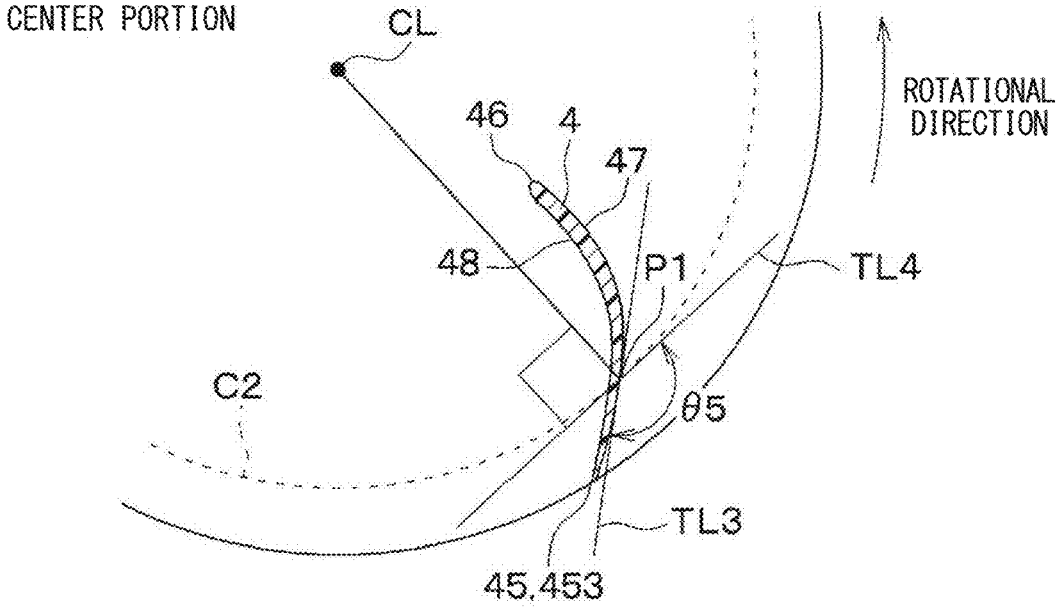
FIG. 13 is a cross-sectional view taken along line VI-VI in FIG. 4 for explaining a positive pressure surface side blade surface angle that is measured at the location of the axial center portion which is centered in the axial direction.
Figure 14:
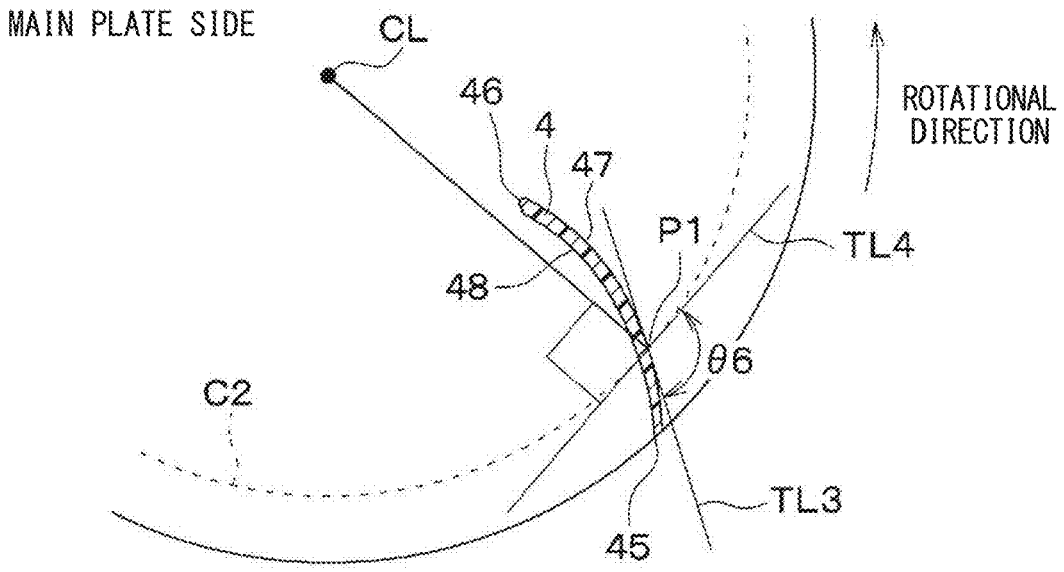
FIG. 14 is a cross-sectional view taken along line VII-VII in FIG. 4 for explaining a positive pressure surface side blade surface angle that is measured at the adjacent location which is adjacent to the main plate.

Next, with reference to FIGS. 12 to 14, a positive pressure surface side blade surface angle of the blade 4 will be described. FIG. 12 shows the cross-section of the same portion as in FIG. 5 (i.e., the portion of the blade 4 adjacent to the shroud 2). FIG. 13 shows the cross-section of the same portion as in FIG. 6 (i.e., the axial center portion of the blade 4). FIG. 14 shows the cross-section of the same portion as in FIG. 7 (i.e., the portion of the blade 4 adjacent to the main plate 3).

As shown in FIGS. 12 to 14, in the following description, a tangent line, which is tangent to the positive pressure surface 47 of the predetermined blade 4 and passes through a predetermined position P1 (hereinafter, referred to as a first predetermined position P1) between the leading edge 46 and the trailing edge 45 of the blade 4, is defined as a third tangent line TL3. A virtual circle (hereinafter, referred to as a second virtual circle C2) is centered on the rotational axis CL and passes through the first predetermined position P1, and a tangent line, which is tangent to the second virtual circle C2 and passes through the first predetermined position P1, is defined as a fourth tangent line TL4. Among a plurality of angles defined between the third tangent line TL3 and the fourth tangent line TL4, an angle, which is placed in front of the third tangent line TL3 in the rotational direction and is on an outer side of the second virtual circle C2 relative to the fourth tangent line TL4, is defined as a positive pressure surface side blade surface angle.

In FIG. 12, the positive pressure surface side blade surface angle, which is measured at the adjacent location of the blade 4 adjacent to the shroud 2 at the first predetermined position P1, is indicated by θ4. In FIG. 13, the positive pressure surface side blade surface angle, which is measured at the location of the axial center portion of the blade 4 at the first predetermined position P1, is indicated by θ5. In FIG. 14, the positive pressure surface side blade surface angle, which is measured at the adjacent location of the blade 4 adjacent to the main plate 3 at the first predetermined position P1, is indicated by θ6. In the first embodiment, the positive pressure surface side blade surface angle θ6, which is measured at the adjacent location of the blade 4 adjacent to the main plate 3 at the first predetermined position P1, is smaller than the positive pressure surface side blade surface angle θ5, which is measured at the location of the axial center portion of the blade 4 at the first predetermined position P1. Furthermore, the positive pressure surface side blade surface angle θ4, which is measured at the adjacent location of the blade 4 adjacent to the shroud 2 at the first predetermined position P1, is smaller than the positive pressure surface side blade surface angle θ5, which is measured at the location of the axial center portion of the blade 4 at the first predetermined position P1. The axial center portion of the blade 4 at the first predetermined position P1 can be said to be a portion where the positive pressure surface side blade surface angle is the largest among the plurality of locations axially arranged along the blade 4 at the first predetermined position P1.

Figure 15:
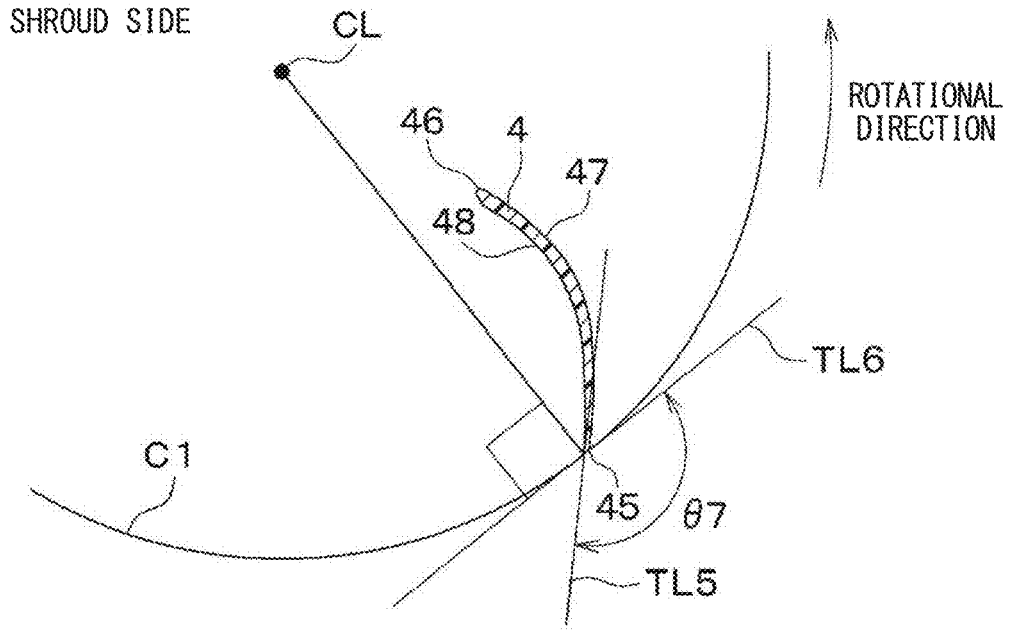
FIG. 15 is a cross-sectional view taken along line V-V in FIG. 4 for explaining a negative pressure surface side outlet angle that is measured at the adjacent location which is adjacent to the shroud.
Figure 16:
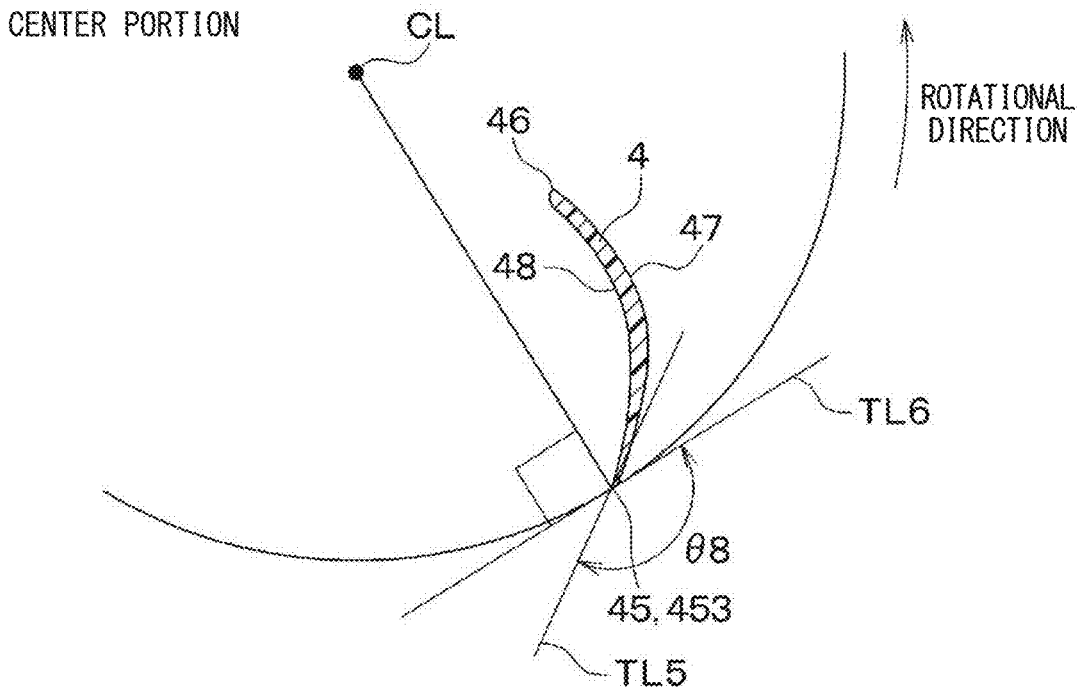
FIG. 16 is a cross-sectional view taken along line VI-VI in FIG. 4 for explaining a negative pressure surface side outlet angle that is measured at the location of the axial center portion which is centered in the axial direction.
Figure 17:
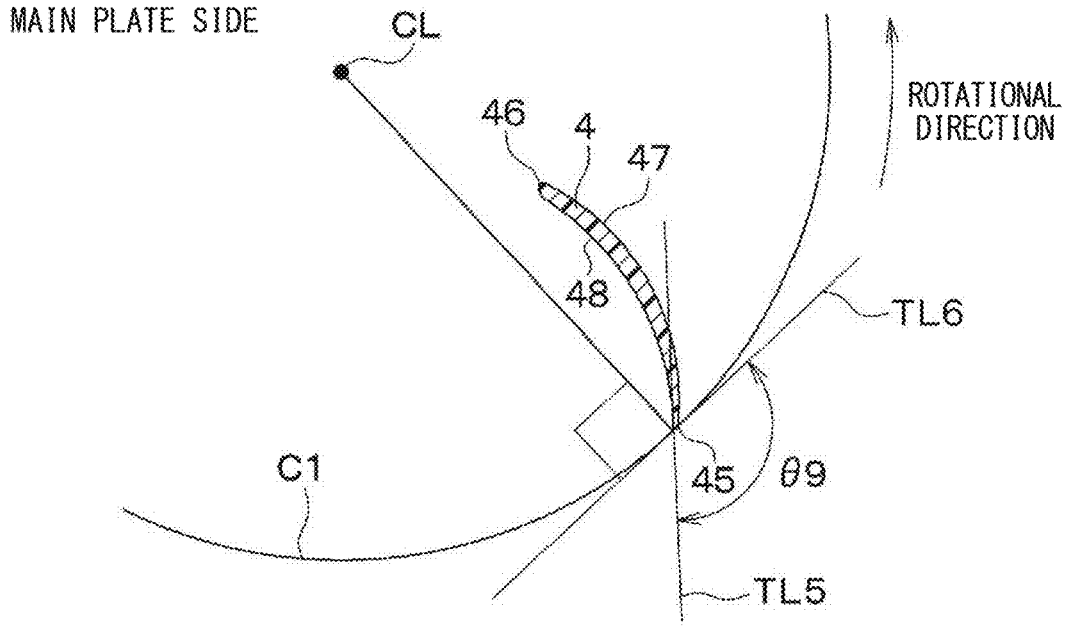
FIG. 17 is a cross-sectional view taken along line VII-VII in FIG. 4 for explaining a negative pressure surface side outlet angle that is measured at the adjacent location which is adjacent to the main plate.

Now, a negative pressure surface side outlet angle at the blade 4 will be described with reference to FIGS. 15 to 17. FIG. 15 shows the cross-section of the same portion as in FIG. 5 (i.e., the portion of the blade 4 adjacent to the shroud 2). FIG. 16 shows the cross-section of the same portion as in FIG. 6 (i.e., the axial center portion of the blade 4). FIG. 17 shows the cross-section of the same portion as in FIG. 7 (i.e., the portion of the blade 4 adjacent to the main plate 3).

As shown in FIGS. 15 to 17, in the following description, a tangent line, which is tangent to a negative pressure surface 48 of the predetermined blade 4 and passes through the trailing edge 45 of the blade 4, is defined as a fifth tangent line TL5. Furthermore, a tangent line, which is tangent to the first virtual circle C1 and passes through the trailing edge 45 of the predetermined blade 4, is defined as a sixth tangent line TL6. Among a plurality of angles defined between the fifth tangent line TL5 and the sixth tangent line TL6, an angle, which is placed in front of the fifth tangent line TL5 in the rotational direction and is on the outer side of the first virtual circle C1 relative to the sixth tangent line TL6, is defined as a negative pressure surface side outlet angle.

In FIG. 15, the negative pressure surface side outlet angle, which is measured at the adjacent location of the trailing edge 45 adjacent to the shroud 2, is indicated by θ7. In FIG. 16, the negative pressure surface side outlet angle, which is measured at the location of the axial center portion 453 of the trailing edge 45, is indicated by θ8. In FIG. 17, the negative pressure surface side outlet angle, which is measured at the adjacent location of the trailing edge 45 adjacent to the main plate 3, is indicated by θ9. In the first embodiment, the negative pressure surface side outlet angle θ9, which is measured at the adjacent location of the trailing edge 45 adjacent to the main plate 3, is smaller than the negative pressure surface side outlet angle θ8, which is measured at the location of the axial center portion 453 of the trailing edge 45. Furthermore, the negative pressure surface side outlet angle θ7, which is measured at the adjacent location of the trailing edge 45 adjacent to the shroud 2, is smaller than the negative pressure surface side outlet angle θ8, which is measured at the location of the axial center portion 453 of the trailing edge 45. The location of the axial center portion 453 of the trailing edge 45 can be said to be a location where the negative pressure surface side outlet angle is the largest among the plurality of locations axially arranged along the trailing edge 45.

Figure 18:
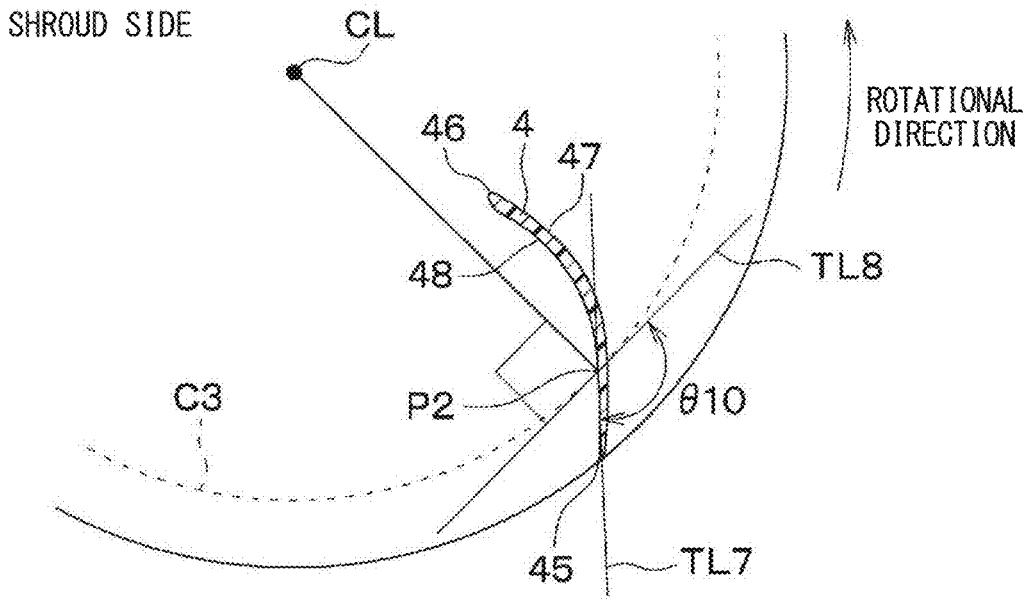
FIG. 18 is a cross-sectional view taken along line V-V in FIG. 4 for explaining a negative pressure surface side blade surface angle that is measured at the adjacent location which is adjacent to the shroud.
Figure 19:
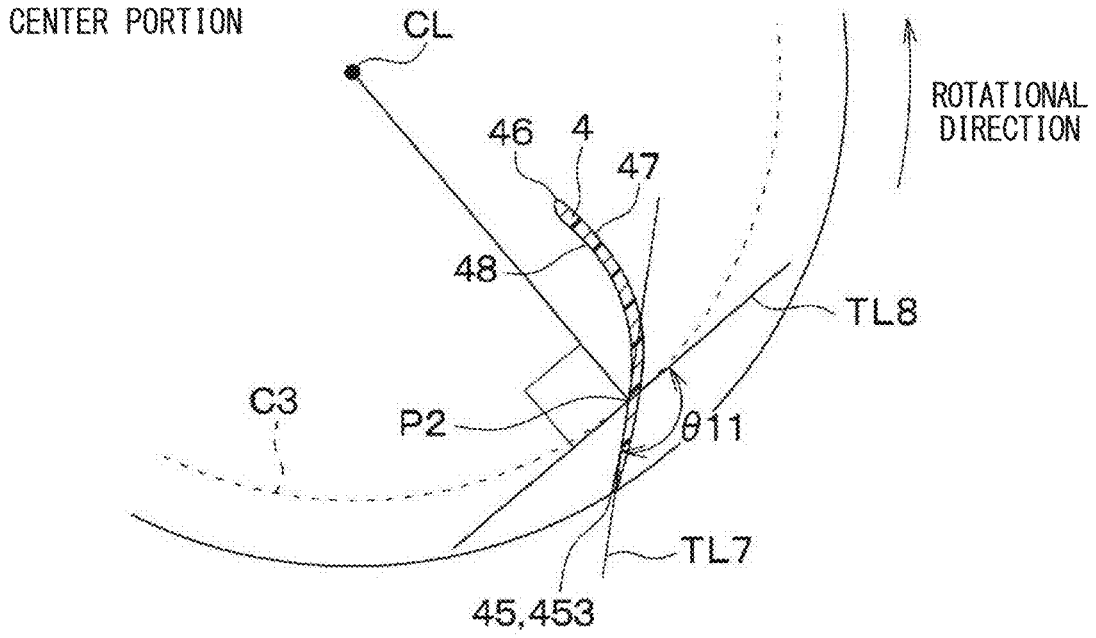
FIG. 19 is a cross-sectional view taken along line VI-VI in FIG. 4 for explaining a negative pressure surface side blade surface angle that is measured at the location of the axial center portion which is centered in the axial direction.
Figure 20:
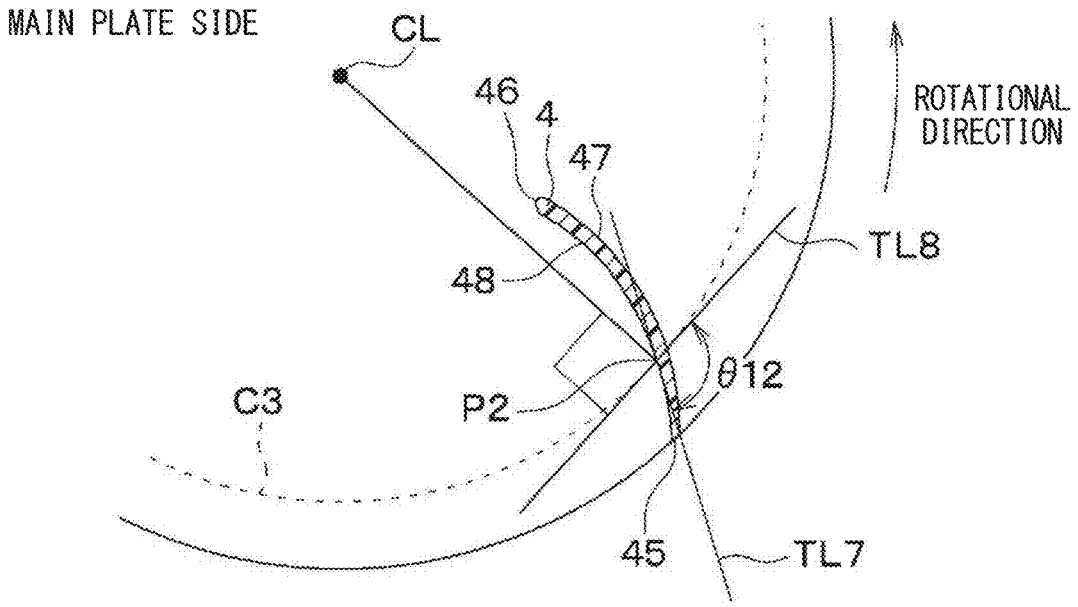
FIG. 20 is a cross-sectional view taken along line VII-VII in FIG. 4 for explaining a negative pressure surface side blade surface angle that is measured at the adjacent location which is adjacent to the main plate.

Next, with reference to FIGS. 18 to 20, a negative pressure surface side blade surface angle of the blade 4 will be described. FIG. 18 shows the cross-section of the same portion as in FIG. 5 (i.e., the portion of the blade 4 adjacent to the shroud 2). FIG. 19 shows the cross-section of the same portion as in FIG. 6 (i.e., the axial center portion of the blade 4). FIG. 20 shows the cross-section of the same portion as in FIG. 7 (i.e., the portion of the blade 4 adjacent to the main plate 3).

As shown in FIGS. 18 to 20, in the following description, a tangent line, which is tangent to the negative pressure surface 48 of the predetermined blade 4 and passes through a predetermined position P2 (hereinafter, referred to as a second predetermined position P2) between the leading edge 46 and the trailing edge 45 of the blade 4, is defined as a seventh tangent line TL7. A virtual circle (hereinafter, referred to as a third virtual circle C3) is centered on the rotational axis CL and passes through the second predetermined position P2, and a tangent line, which is tangent to the third virtual circle C3 and passes through the second predetermined position P2, is defined as an eighth tangent line TL8. Among a plurality of angles defined between the seventh tangent line TL7 and the eighth tangent line TL8, an angle, which is placed in front of the seventh tangent line TL7 in the rotational direction and is on an outer side of the third virtual circle C3 relative to the eighth tangent line TL8, is defined as a negative pressure surface side blade surface angle.

In FIG. 18, the negative pressure surface side blade surface angle, which is measured at the adjacent location of the blade 4 adjacent to the shroud 2 at the second predetermined position P2, is indicated by θ10. In FIG. 19, the negative pressure surface side blade surface angle, which is measured at the location of the axial center portion of the blade 4 at the second predetermined position P2, is indicated by θ11. In FIG. 20, the negative pressure surface side blade surface angle, which is measured at the adjacent location of the blade 4 adjacent to the main plate 3 at the second predetermined position P2, is indicated by θ12. In the first embodiment, the negative pressure surface side blade surface angle θ12, which is measured at the adjacent location of the blade 4 adjacent to the main plate 3 at the second predetermined position P2, is smaller than the the negative pressure surface side blade surface angle θ11, which is measured at the location of the axial center portion 453 of the blade 4 at the second predetermined position P2. Furthermore, the negative pressure surface side blade surface angle θ10, which is measured at the adjacent location of the blade 4 adjacent to the shroud 2 at the second predetermined position P2, is smaller than the negative pressure surface side blade surface angle θ11, which is measured at the location of the axial center portion 453 of the blade 4 at the second predetermined position P2. The location of the axial center portion 453 of the blade 4 at the second predetermined position P2 can be said to be a location where the negative pressure surface side blade surface angle is the largest among the plurality of locations axially arranged along the blade 4 at the second predetermined position P2.

Each of the blades 4 of the centrifugal fan 1 of the present embodiment is shaped so that the negative pressure surface side outlet angle and the positive pressure surface side outlet angle are different from each other, and the negative pressure surface side blade surface angle and the positive pressure surface side blade surface angle are different from each other. With this configuration, it is possible to limit the detachment of the airflow at the negative pressure surface 48 and also to adjust the amount of work applied from the blade 4 to the airflow at the positive pressure surface 47, and thereby the airflow velocity distribution of the airflow in the inter-blade passage 43 can be made closer to uniform.

The centrifugal fan 1 of the first embodiment described above implements the following actions and effects.

(1) The centrifugal fan 1 of the first embodiment has the at least one inflection point POI, at which the increase or decrease in the outlet angle is changed, at the trailing edge 45 of the blade 4. Furthermore, the outlet angle θ3, which is measured at the adjacent location of the trailing edge 45 adjacent to the main plate 3, and the outlet angle θ1, which is measured at the adjacent location of the trailing edge 45 adjacent to the shroud 2, are both smaller than the outlet angle θ2 which is measured at the location of the trailing edge 45 where the outlet angle is the largest.

According to this configuration, the centrifugal fan 1 described above is effective in a case where the airflow velocity in the shroud 2 side region and the airflow velocity in the main plate 3 side region at the blade outlet 44 are both low, and the airflow velocity in the axial center region of the blade outlet 44 is high in the hypothetical structure where the trailing edge 45 is formed parallel to the rotational axis CL. In this case, in the centrifugal fan 1 of the first embodiment, the outlet angle θ1, which is measured at the adjacent location of the trailing edge 45 adjacent to the shroud 2, and the outlet angle θ3, which is measured at the adjacent location of the trailing edge 45 adjacent to the main plate 3, are both made small, and thereby the airflow velocity in these regions are accelerated in comparison to the other region(s) at the trailing edge 45. Furthermore, by increasing the outlet angle θ2 which is measured at the location of the axial center portion 453 of the trailing edge 45, the airflow velocity at the region of the axial center portion 453 can be decelerated in comparison to the other regions at the trailing edge 45. Therefore, with the centrifugal fan 1 of the first embodiment, the airflow velocity distribution of the airflow discharged from the blade outlet 44 can be made closer to uniform, and thereby it is possible to reduce the noise and improve the air blowing efficiency.

(2) In the centrifugal fan 1 of the first embodiment, the blade surface angle θ6, which is measured at the adjacent location of the blade 4 adjacent to the main plate 3 at the predetermined position P1, and the blade surface angle θ4, which is measured at the adjacent location of the blade 4 adjacent to the shroud 2 at the predetermined position P1, are smaller than the blade surface angle θ5, which is measured at the corresponding location of the blade 4 at the predetermined position P1 where the blade surface angle is the largest among the plurality of locations axially arranged along the blade 4 at the predetermined position P1.

According to this configuration, even for the airflow in the inter-blade passage 43, by changing the amount of work applied from the blade 4 to the airflow, the detachment of the airflow from the blade surface can be limited, and the airflow velocity distribution can gradually become uniform starting from the upstream side of the blade outlet 44.

The configuration of changing the blade surface angle from the middle of the blade 4 between the leading edge 46 and the trailing edge 45 and its actions and effects are the same in the second to eleventh embodiments described below.

(3) Each of the blades 4 of the centrifugal fan 1 of the first embodiment is shaped so that the negative pressure surface side outlet angle and the positive pressure surface side outlet angle are different from each other, and the negative pressure surface side blade surface angle and the positive pressure surface side blade surface angle are different from each other.

With this configuration, it is possible to limit the detachment of the airflow at the negative pressure surface 48 and also to adjust the amount of work applied from the blade 4 to the airflow at the positive pressure surface 47, and thereby the airflow velocity distribution of the airflow discharged from the blade outlet 44 can be made closer to uniform. The configuration described above and its actions and effects are the same in the second to eleventh embodiments described below.

Second Embodiment

Next, a second embodiment will be described. The second embodiment is a modification where the shape of the trailing edge 45 of each blade 4 is changed from that of the first embodiment, and the rest of the second embodiment is the same as that of the first embodiment. Therefore, only the parts different from those of the first embodiment will be described in the following description.

Figure 21:
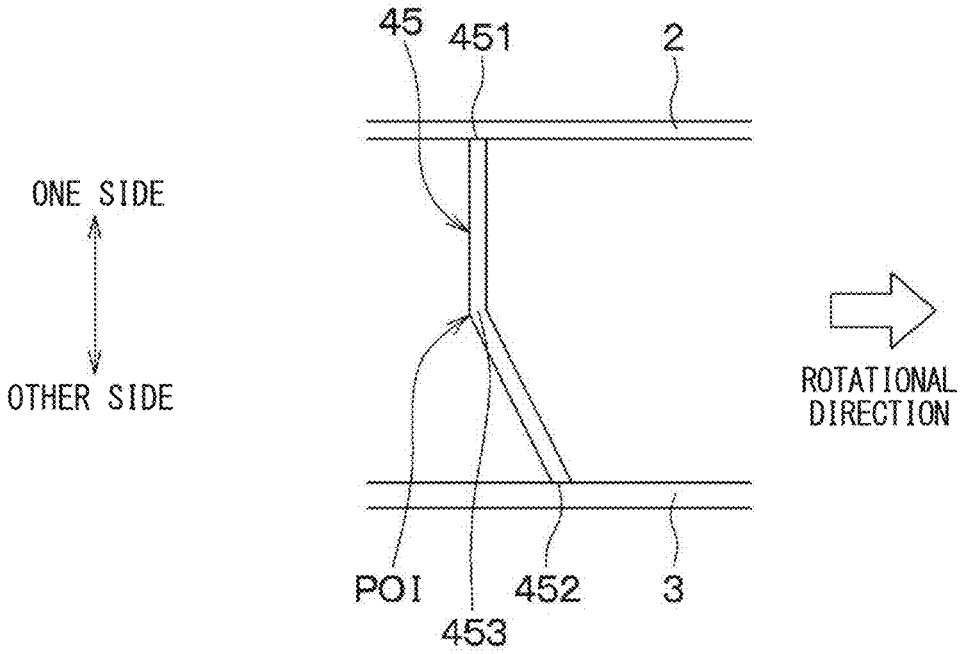
FIG. 21 is an enlarged side view of a portion of a centrifugal fan of a second embodiment corresponding to FIG. 4.

As shown in FIG. 21, in the second embodiment, a portion of the trailing edge 45 of the blade 4, which extends from the portion 451 joined to the shroud 2 to the axial center portion 453, is generally parallel with the rotational axis CL. Furthermore, another portion of the trailing edge 45 of the blade 4, which extends from the axial center portion 453 to the portion 452 joined to the main plate 3, is progressively displaced toward the forward side in the rotational direction. Therefore, in the second embodiment, the outlet angle measured at the portion (location) of the trailing edge 45 of the blade 4, which extends from the portion 452 joined to the main plate 3 to the axial center portion 453, is smaller than the outlet angle measured at the portion (location) of the trailing edge 45 of the blade 4, which extends from the portion 451 joined to the shroud 2 to the axial center portion 453. The portion of the trailing edge 45 of the blade 4, which extends from the portion 451 joined to the shroud 2 to the axial center portion 453, can be said to be a portion (location) where the outlet angle is the largest among the plurality of locations axially arranged along the trailing edge 45.

Furthermore, the centrifugal fan 1 of the second embodiment is also configured such that when a change in the outlet angle is viewed at each of the plurality of locations axially arranged along the trailing edge 45, the trailing edge 45 has at least one inflection point POI where an increase or decrease in the outlet angle is changed. In the second embodiment, the inflection point POI is located at the location of the axial center portion 453 of the trailing edge 45.

The centrifugal fan 1 of the second embodiment described above is configured such that the outlet angle measured at the portion (location) of the trailing edge 45 of the blade 4, which extends from the portion 451 joined to the shroud 2 to the axial center portion 453, is made large. Therefore, the centrifugal fan 1 can decelerate the high airflow velocity in the region extending from the shroud 2 to the axial center in the inter-blade passage 43 in comparison to the other region (s) in the inter-blade passage 43. In addition, the centrifugal fan 1 is configured such that the outlet angle measured at the location of the trailing edge 45 adjacent to the main plate 3 is made small. Therefore, the centrifugal fan 1 can accelerate the low airflow velocity in the region adjacent to the main plate 3 in the inter-blade passage 43 in comparison to the other region(s) in the inter-blade passage 43. Therefore, with the centrifugal fan 1, the airflow velocity distribution of the airflow discharged from the blade outlet 44 can be made closer to uniform, and thereby it is possible to reduce the noise and improve the air blowing efficiency.

Third Embodiment

Next, a third embodiment will be described. The third embodiment is a modification where the shape of the trailing edge 45 of the blade 4 is changed from that of the first embodiment, and the rest of the third embodiment is the same as that of the first embodiment. Therefore, only the parts different from those of the first embodiment will be described in the following description.

Figure 22:
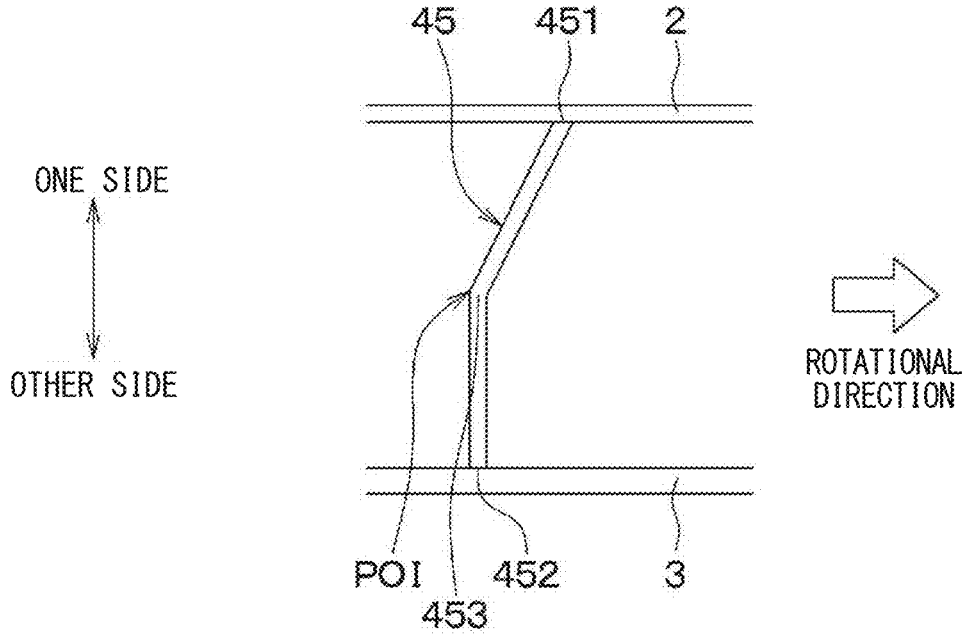
FIG. 22 is an enlarged side view of a portion of a centrifugal fan of a third embodiment corresponding to FIG. 4.

As shown in FIG. 22, in the third embodiment, the portion of the trailing edge 45 of the blade 4, which extends from the portion 452 joined to the main plate 3 to the axial center portion 453, is generally parallel with the rotational axis CL. Furthermore, the portion of the trailing edge 45 of the blade 4, which extends from the axial center portion 453 to the portion 451 joined to the shroud 2, is progressively displaced toward the forward side in the rotational direction. Therefore, in the third embodiment, the outlet angle measured at the portion (location) of the trailing edge 45 of the blade 4, which extends from the portion 451 joined to the shroud 2 to the axial center portion 453, is smaller than the outlet angle measured at the portion (location) of the trailing edge 45 of the blade 4, which extends from the portion 452 joined to the main plate 3 to the axial center portion 453. The portion (location) of the trailing edge 45 of the blade 4, which extends from the portion 452 joined to the main plate 3 to the axial center portion 453, can be said to be a portion (location) where the outlet angle is the largest among the portions (locations) axially arranged along the trailing edge 45.

Furthermore, the centrifugal fan 1 of the third embodiment is also configured such that when a change in the outlet angle is viewed at each of the plurality of locations axially arranged along the trailing edge 45, the trailing edge 45 has at least one inflection point POI where an increase or decrease in the outlet angle is changed. In the third embodiment, the inflection point POI is located at the location of the axial center portion 453 of the trailing edge 45.

The centrifugal fan 1 of the third embodiment described above is configured such that the outlet angle measured at the portion (location) of the trailing edge 45 of the blade 4, which extends from the portion 452 joined to the main plate 3 to the axial center portion 453, is made large. Therefore, the centrifugal fan 1 can decelerate the high airflow velocity in the region extending from the main plate 3 to the axial center in the inter-blade passage 43 in comparison to the other region(s) in the inter-blade passage 43. In addition, the centrifugal fan 1 of the third embodiment is configured such that the outlet angle at the location of the portion 451 of the trailing edge 45 adjacent to the shroud 2 is made small. Therefore, the centrifugal fan 1 can accelerate the low airflow velocity in the region adjacent to the shroud 2 in the inter-blade passage 43 in comparison to the other regions in the inter-blade passage 43. Therefore, with the centrifugal fan 1 described above, the airflow velocity distribution of the airflow discharged from the blade outlet 44 can be made closer to uniform, and thereby it is possible to reduce the noise and improve the air blowing efficiency.

Fourth Embodiment

Next, a fourth embodiment will be described. The fourth embodiment is a modification where the shape of the trailing edge 45 of the blade 4 is changed from that of the first embodiment, and the rest of the fourth embodiment is the same as that of the first embodiment. Therefore, only the parts different from those of the first embodiment will be described in the following description.

Figure 23:
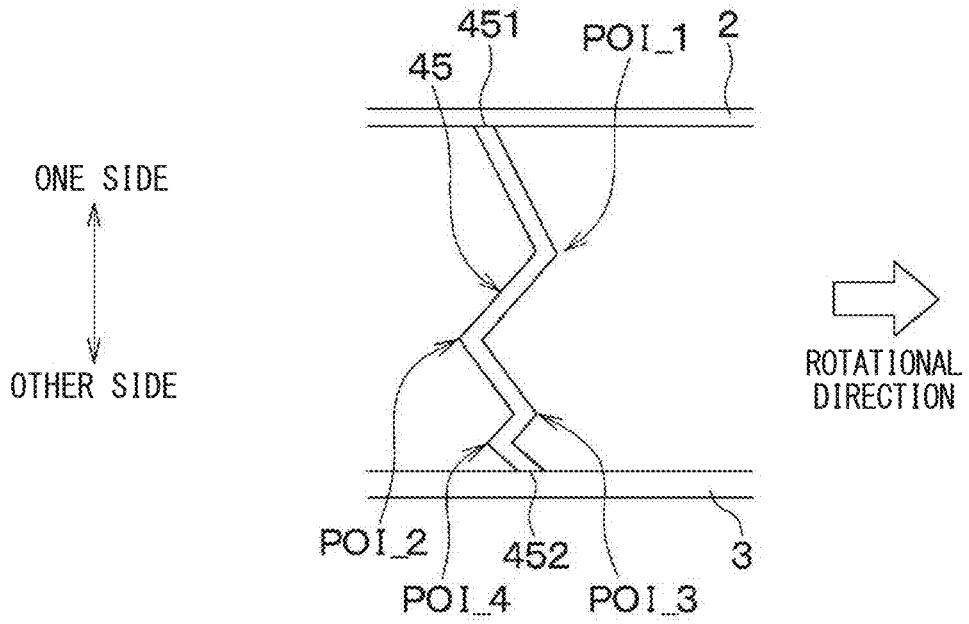
FIG. 23 is an enlarged side view of a portion of a centrifugal fan of a fourth embodiment corresponding to FIG. 4.

As shown in FIG. 23, in the fourth embodiment, when a change in the outlet angle is viewed at each of a plurality of locations axially arranged along the trailing edge 45, the trailing edge 45 has at least two inflection points POI where an increase or decrease in the outlet angle is changed. Specifically, in the fourth embodiment, the trailing edge 45 has four inflection points POI_1, POI_2, POI_3, POI_4. Each of connecting portions of the trailing edge 45, each of which connects between corresponding adjacent two of the four inflection points POI_1, POI_2, POI_3, POI_4, is straight.

The configuration of the fourth embodiment is effective in a case where a pressure dropping element located on the upstream side of the centrifugal fan 1 or the shape or physique of each corresponding component of the centrifugal fan 1 causes variations in the airflow velocity distribution in the respective regions of the blade outlet 44 in the hypothetical structure where the trailing edge 45 is formed parallel to the rotational axis CL. The pressure dropping element refers to an element, such as a case of the blower at which the centrifugal fan 1 is installed, a filter placed on the upstream side of the centrifugal fan 1, causing a pressure drop in the airflow. In such a case, even in the fourth embodiment, the outlet angle measured at the location of the trailing edge 45, at which the airflow velocity is low, is made small, and the outlet angle measured at the location of the trailing edge 45, at which the airflow velocity is high, is made large. As described above, by reducing the outlet angle, the amount of work applied from the blade 4 to the airflow can be increased, and thereby the airflow velocity can be increased in comparison to the other locations. In contrast, by increasing the outlet angle, the amount of work applied from the blade 4 to the airflow can be decreased, and thereby the airflow velocity can be decreased in comparison to the other locations. Therefore, the airflow velocity distribution of the airflow discharged from the blade outlet 44 can be made closer to uniform even in a case where the variations occur at the regions of the blade outlet 44 in the airflow velocity distribution of the airflow discharged from the blade outlet 44 in the hypothetical structure where the trailing edge 45 is formed parallel to the rotational axis CL. Therefore, with the centrifugal fan 1 of the fourth embodiment, it is possible to reduce the noise and improve the air blowing efficiency.

Fifth Embodiment

Next, a fifth embodiment will be described. The fifth embodiment is a modification of the fourth embodiment.

Figure 24:
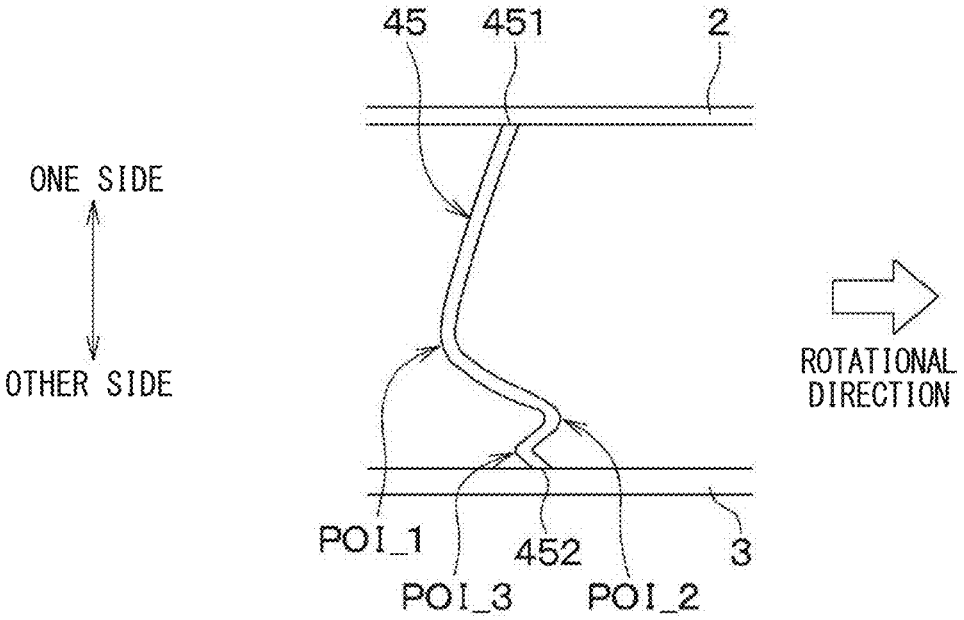
FIG. 24 is an enlarged side view of a portion of a centrifugal fan of a fifth embodiment corresponding to FIG. 4.

As shown in FIG. 24, even in the fifth embodiment, when a change in the outlet angle is viewed at each of a plurality of locations axially arranged along the trailing edge 45, the trailing edge 45 has at least two inflection points POI where an increase or decrease in the outlet angle is changed. Specifically, in the fifth embodiment, the trailing edge 45 has three inflection points POI_1, POI_2, POI_3. Each of connecting portions of the trailing edge 45, each of which connects between corresponding adjacent two of the three inflection points POI_1, POI_2, POI_3, is curved.

Even with the configuration of the fifth embodiment, the airflow velocity distribution of the airflow discharged from the blade outlet 44 can be made closer to uniform even in the case where the variations occur at the regions of the blade outlet 44 in the airflow velocity distribution of the airflow discharged from the blade outlet 44 in the hypothetical structure where the trailing edge 45 is formed parallel to the rotational axis CL. Therefore, with the centrifugal fan 1 of the fifth embodiment, it is possible to reduce the noise and improve the air blowing efficiency.

Sixth Embodiment

Next, a sixth embodiment will be described. The sixth embodiment is a modification of the fourth or fifth embodiment.

Figure 25:
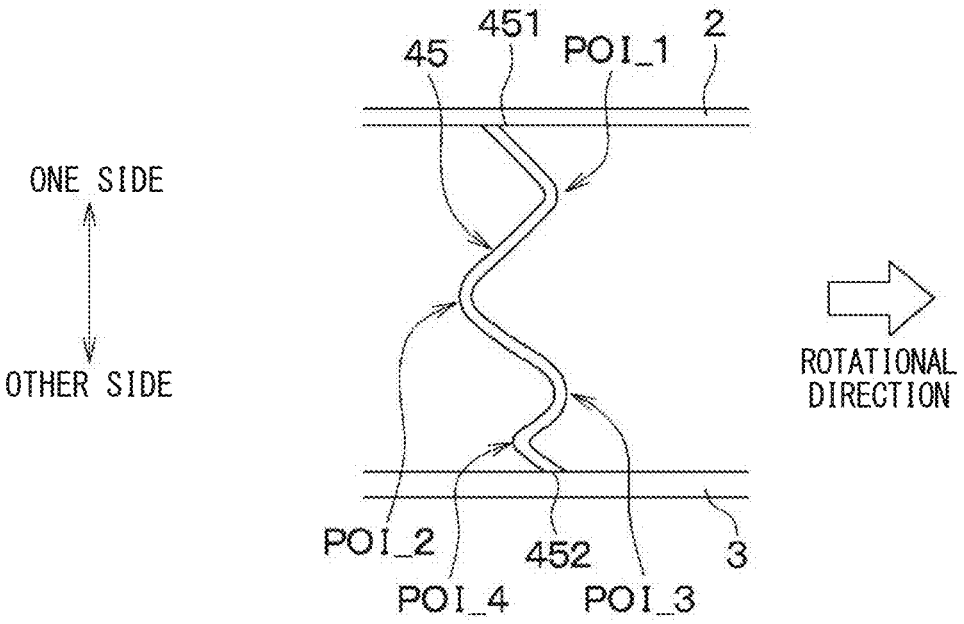
FIG. 25 is an enlarged side view of a portion of a centrifugal fan of a sixth embodiment corresponding to FIG. 4.

As shown in FIG. 25, even in the sixth embodiment, when a change in the outlet angle is viewed at each of a plurality of locations axially arranged along the trailing edge 45, the trailing edge 45 has at least two inflection points POI where an increase or decrease in the outlet angle is changed. Specifically, in the sixth embodiment, the trailing edge 45 has four inflection points POI_1, POI_2, POI_3, POI_4. Each of connecting portions of the trailing edge 45, each of which connects between corresponding adjacent two of the four inflection points POI_1, POI_2, POI_3, POI_4, is curved.

Even with the configuration of the sixth embodiment, the airflow velocity distribution of the airflow discharged from the blade outlet 44 can be made closer to uniform even in the case where the variations occur at the regions of the blade outlet 44 in the airflow velocity distribution of the airflow discharged from the blade outlet 44 in the hypothetical structure where the trailing edge 45 is formed parallel to the rotational axis CL. Therefore, with the centrifugal fan 1 of the sixth embodiment, it is possible to reduce the noise and improve the air blowing efficiency.

Seventh to Eleventh Embodiments

Each of seventh to eleventh embodiments is a modification where the shape of the trailing edge 45 of the blade 4 viewed in the rotational direction is changed from that of the first embodiment, and the rest of each of the seventh to eleventh embodiments is the same as that of the first embodiment. Therefore, only the parts different from those of the first embodiment will be described in the following description. Any one of the configurations of the seventh to eleventh embodiments can be combined with any one of the configurations of the first to sixth embodiments described above.

Seventh Embodiment

Figure 26:
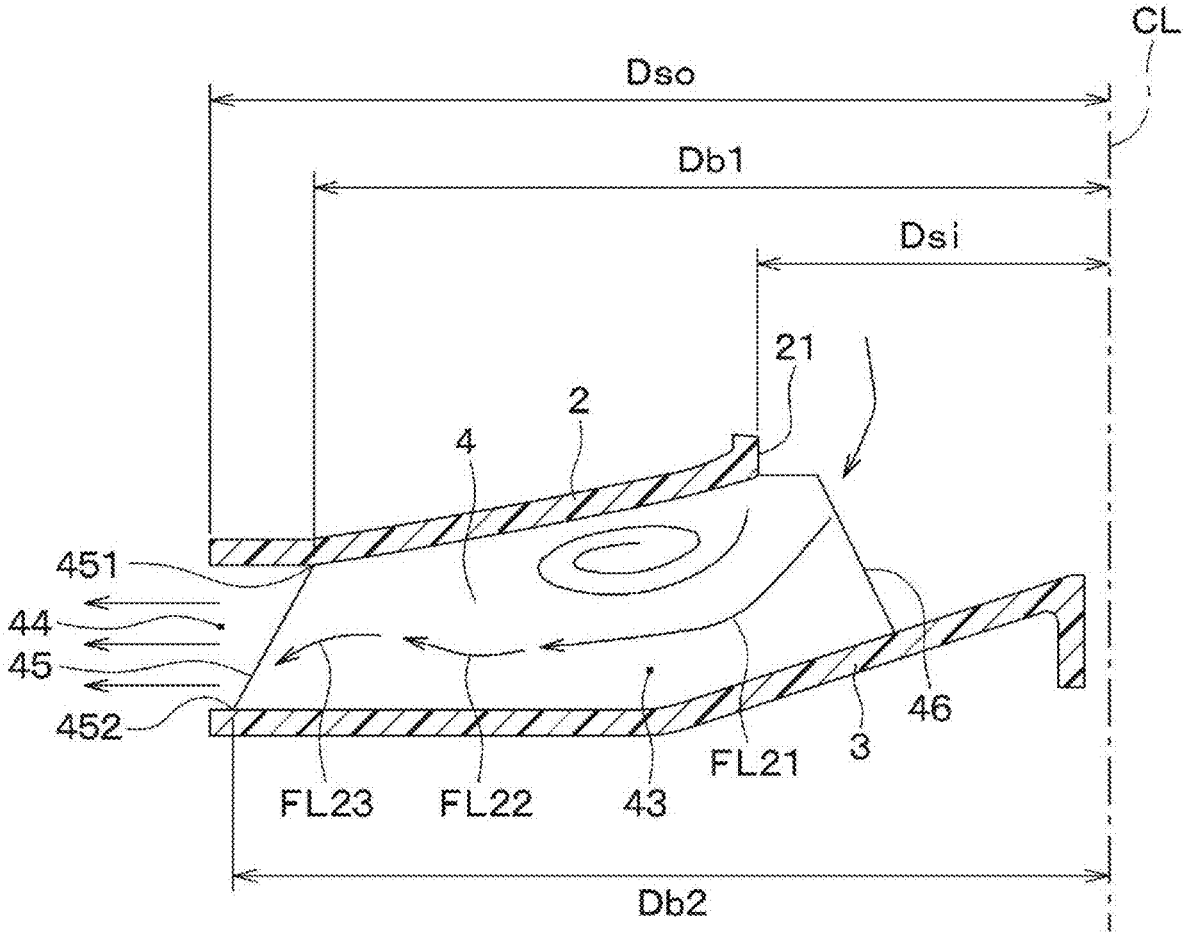
FIG. 26 is a diagram showing a blade of a centrifugal fan of a seventh embodiment seen in the rotational direction.

As shown in FIG. 26, in the seventh embodiment, a distance Db2, which is measured between the rotational axis CL and the portion 452 of the trailing edge 45 joined to the main plate 3, is longer than a distance Db1, which is measured between the rotational axis CL and the portion 451 of the trailing edge 45 joined to the shroud 2. The trailing edge 45 is formed straight such that the distance between the trailing edge 45 and the rotational axis CL is progressively reduced from the portion 452 joined to the main plate 3 to the portion 451 joined to the shroud 2. The significance of the above configuration of the trailing edge 45 viewed in the rotational direction will be described hereinafter.

As indicated by an arrow FL21 in FIG. 26, the airflow in the inter-blade passage 43 is detached from the shroud 2 around the leading edge 46 and is temporarily biased toward the main plate 3. However, as indicated by an arrow FL22, the airflow then flows such that the airflow is reattached to the shroud 2 in the middle of the inter-blade passage 43. Therefore, at the blade outlet 44, the airflow may possibly be biased toward the shroud 2, and thereby the airflow distribution may possibly be formed such that the airflow is biased in the axial direction.

In contrast, the centrifugal fan 1 of the seventh embodiment is configured such that the amount of work applied from the main plate 3 side portion of the blade 4 to the airflow is increased, and thereby as indicated by an arrow FL23, the airflow around the blade outlet 44 can be pulled once again toward the main plate 3 at the inter-blade passage 43. Therefore, in comparison to the case of the hypothetical structure where the trailing edge 45 is formed parallel to the rotational axis CL, the airflow velocity distribution of the airflow discharged from the blade outlet 44 can be made closer to uniform, and thereby it is possible to reduce the noise and improve the air blowing efficiency.

The configuration of the centrifugal fan 1 of the seventh embodiment is more effective in a case where a relationship of $0.5<Dsi/Dso<0.7$ is satisfied. Here, Dsi denotes an inner diameter of the shroud 2, and Dso denotes an outer diameter of the shroud 2. This is due to the following reasons.

In a hypothetical case where the ratio of Dsi/Dso is equal to or smaller than 0.5, it is possible to ensure the sufficient length of the inter-blade passage 43 for conducting the airflow after the occurrence of the biasing of the airflow toward the shroud 2. In this case, even when the trailing edge 45 is formed parallel to the rotational axis CL in the view taken in the rotational direction, after the occurrence of the biasing of the airflow toward the shroud 2, this biasing of the airflow is alleviated before reaching the trailing edge 45. In contrast, in another hypothetical case where the ratio of Dsi/Dso is equal to or larger than 0.7, the airflow in the inter-blade passage 43 reaches the trailing edge 45 before occurrence of biasing of the airflow that causes reattachment of the airflow to the shroud 2. In other words, the airflow indicated by the arrows FL21, FL22 is cut off in the middle. Therefore, in order to make the configuration of the centrifugal fan 1 of the seventh embodiment more useful, it is desirable that the relationship of $0.5<Dsi/Dso<0.7$ is satisfied.

The centrifugal fan 1 of the seventh embodiment described above is configured such that the distance Db2, which is measured between the rotational axis CL and the portion 452 of the trailing edge 45 joined to the main plate 3, is longer than the distance Db1, which is measured between the rotational axis CL and the portion 451 of the trailing edge 45 joined to the shroud 2.

With this configuration, the amount of work applied from the main plate 3 side portion of the blade 4 to the airflow is increased, and thereby the airflow around the blade outlet 44 in the inter-blade passage 43 can be pulled once again toward the main plate 3. Therefore, in comparison to the case of the hypothetical structure where the trailing edge 45 is formed parallel to the rotational axis CL, the airflow velocity distribution of the airflow discharged from the blade outlet 44 can be made closer to uniform, and thereby it is possible to reduce the noise and improve the air blowing efficiency.

The centrifugal fan 1 of each of the eighth to eleventh embodiments described hereinafter is also configured such that the distance Db2, which is measured between the rotational axis CL and the portion 452 of the trailing edge 45 joined to the main plate 3, is longer than the distance Db1, which is measured between the rotational axis CL and the portion 451 of the trailing edge 45 joined to the shroud 2. Therefore, the centrifugal fan 1 of each of the eighth to eleventh embodiments also has the same configuration as the seventh embodiment described above with respect to the above-described point, and thus can achieve the same actions and effects as the centrifugal fan 1 of the seventh embodiment.

Eighth Embodiment

Figure 27:
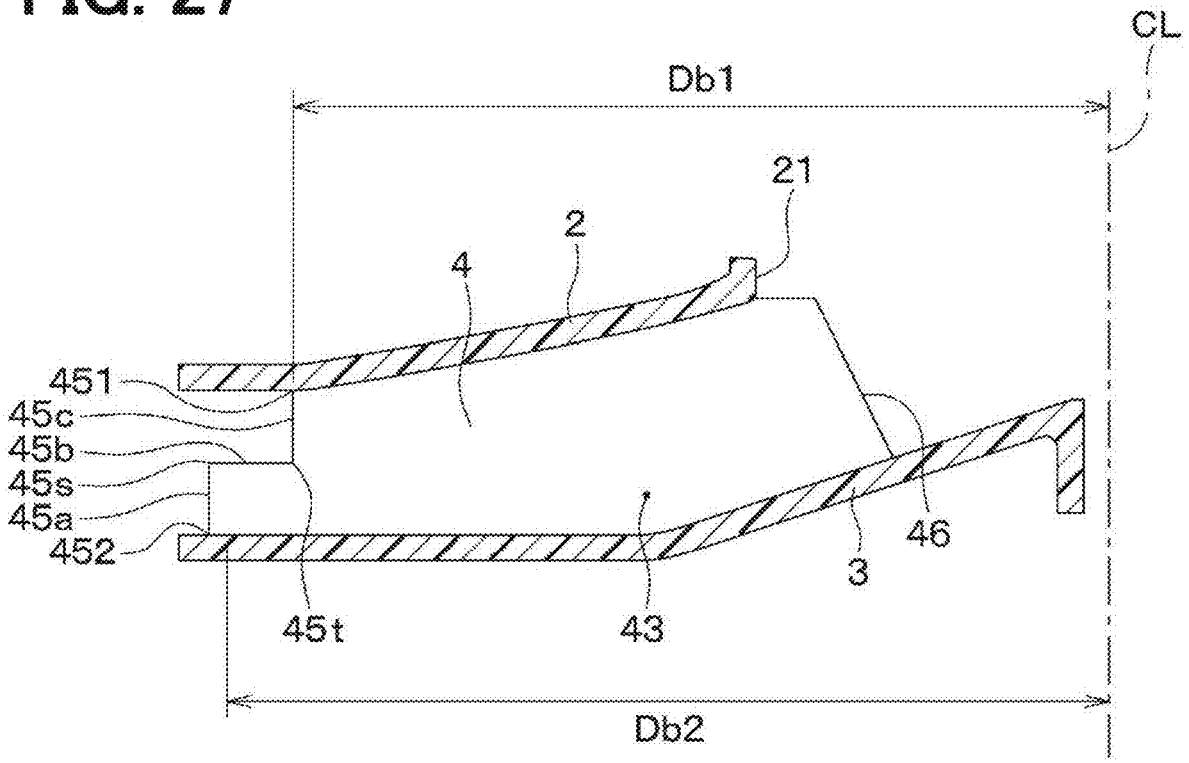
FIG. 27 is a diagram showing a blade of a centrifugal fan of an eighth embodiment seen in the rotational direction.

As shown in FIG. 27, in the eighth embodiment, the trailing edge 45 is formed in a stepped form such that the distance between the trailing edge 45 and the rotational axis CL is reduced in a stepwise manner from the portion 452 joined to the main plate 3 to the portion 451 joined to the shroud 2. Specifically, the trailing edge 45 has a first trailing edge portion 45*a*, a second trailing edge portion 45*b* and a third trailing edge portion 45*c*. The first trailing edge portion 45*a* extends in the axial direction from the main plate 3 toward the shroud 2. The second trailing edge portion 45*b* extends in the radial direction toward the rotational axis CL from an end of the first trailing edge portion 45*a* which faces the shroud 2. The third trailing edge portion 45*c* extends toward the shroud 2 in the axial direction from an end of the second trailing edge portion 45*b* which faces the rotational axis CL. Therefore, in the eighth embodiment, the trailing edge 45 is shaped in the stepped form including two corners 45*s*, 45*t* and three straight portions (i.e., the first to third trailing edge portions 45*a* to 45*c*).

The centrifugal fan 1 of the eighth embodiment described above can achieve the same actions and effects as those of the seventh embodiment.

Ninth Embodiment

Figure 28:
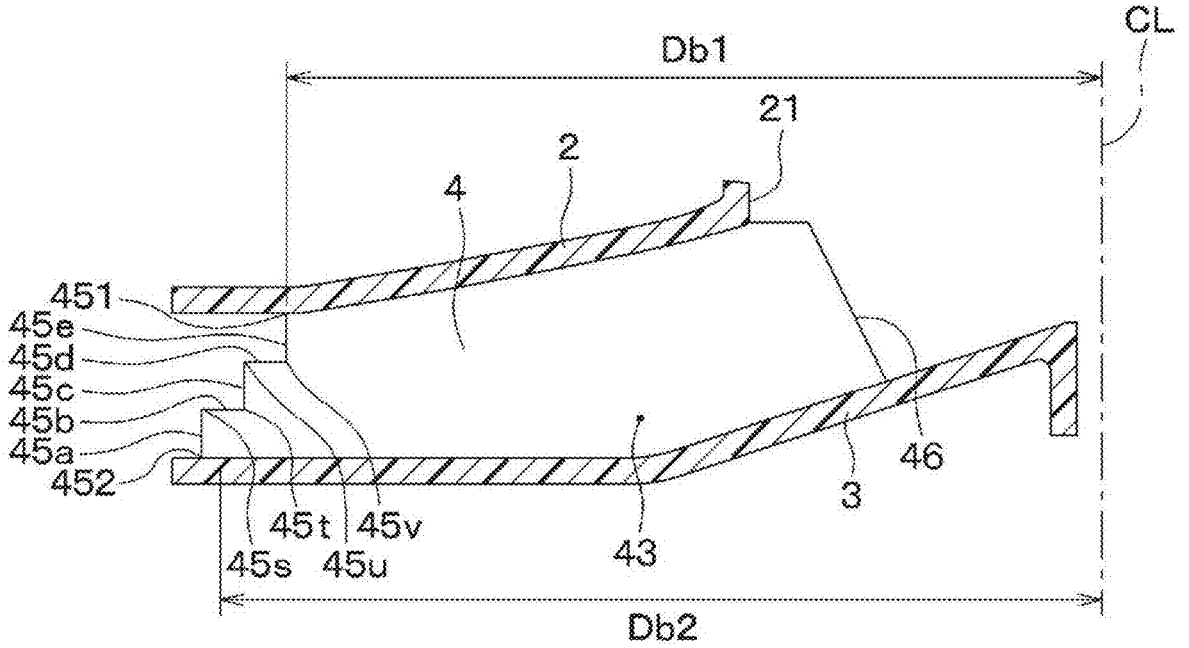
FIG. 28 is a diagram showing a blade of a centrifugal fan of a ninth embodiment seen in the rotational direction.

As shown in FIG. 28, even in the ninth embodiment, the trailing edge 45 is formed in a stepped form such that the distance between the trailing edge 45 and the rotational axis CL is reduced in a stepwise manner from the portion 452 joined to the main plate 3 to the portion 451 joined to the shroud 2. Specifically, the trailing edge 45 has the first trailing edge portion 45*a*, the second trailing edge portion 45*b*, the third trailing edge portion 45*c*, a fourth trailing edge portion 45*d* and a fifth trailing edge portion 45*e*. The first trailing edge portion 45*a* extends in the axial direction from the main plate 3 toward the shroud 2. The second trailing edge portion 45*b* extends in the radial direction toward the rotational axis CL from an end of the first trailing edge portion 45*a* which faces the shroud 2. The third trailing edge portion 45*c* extends toward the shroud 2 in the axial direction from an end of the second trailing edge portion 45*b* which faces the rotational axis CL. The fourth trailing edge portion 45*d* extends in the radial direction toward the rotational axis CL from an end of the third trailing edge portion 45*c* which faces the shroud 2. The fifth trailing edge portion 45*e* extends toward the shroud 2 in the axial direction from an end of the fourth trailing edge portion 45*d* which faces the rotational axis CL. Therefore, in the ninth embodiment, the trailing edge 45 is shaped in the stepped form including four corners 45*s* to 45*v* and five straight portions (i.e., the first to fifth trailing edge portions 45*a* to 45*e*).

The centrifugal fan 1 of the ninth embodiment described above can achieve the same actions and effects as those of the seventh and eighth embodiments. The number of the corners and the number of the straight portions of the stepped form of the trailing edge 45 can be set to any number.

Tenth Embodiment

Figure 29:
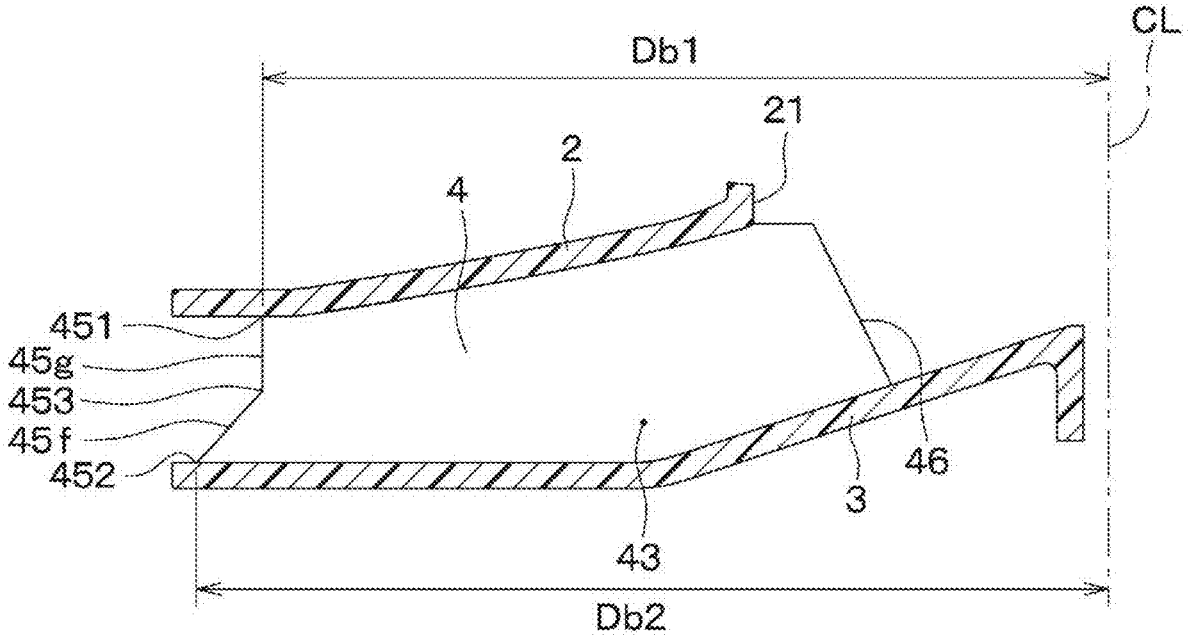
FIG. 29 is a diagram showing a blade of a centrifugal fan of a tenth embodiment seen in the rotational direction.

As shown in FIG. 29, in the tenth embodiment, the trailing edge 45 has a slope portion 45*f* and a straight portion 45*g*. The slope portion 45*f* is in a straight form and extends from the portion 452 joined to the main plate 3 toward the axial center portion 453 such that a distance between the slope portion 45*f* and the rotational axis CL is progressively decreased. The straight portion 45*g* extends in parallel with the rotational axis CL from the axial center portion 453 to the portion 451 joined to the shroud 2.

The centrifugal fan 1 of the tenth embodiment described above can also achieve the same actions and effects as those of the seventh to ninth embodiments.

Eleventh Embodiment

Figure 30:
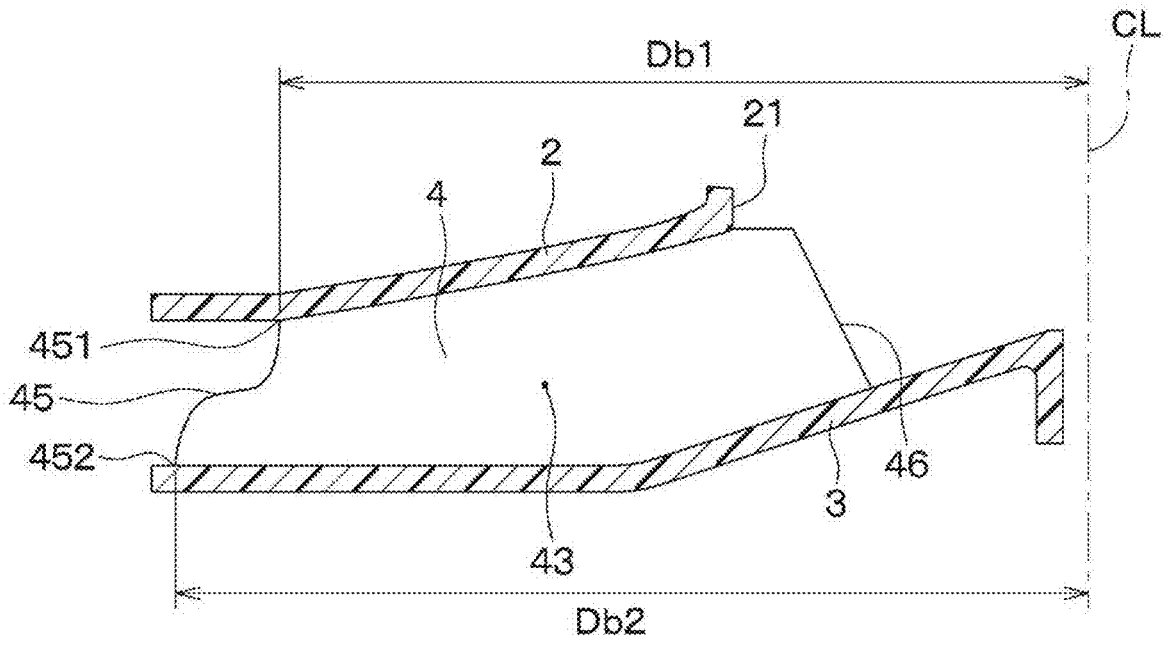
FIG. 30 is a diagram showing a blade of a centrifugal fan of an eleventh embodiment seen in the rotational direction.

As shown in FIG. 30, in the eleventh embodiment, the trailing edge 45 is formed in a curved form such that the distance between the trailing edge 45 and the rotational axis CL is progressively reduced from the portion 452 joined to the main plate 3 to the portion 451 joined to the shroud 2. The shape of this curve of the trailing edge 45 can be set arbitrarily.

The centrifugal fan 1 of the eleventh embodiment described above can also achieve the same actions and effects as those of the seventh to tenth embodiments.

OTHER EMBODIMENTS

In each of the embodiments described above, the centrifugal fan 1 is described as the turbofan. However, the present disclosure is not limited to this. For example, the centrifugal fan 1 may be any other type, such as a radial fan.

In each of the embodiments described above, although the configuration of the predetermined blade 4 among the plurality of blades 4 of the centrifugal fan 1 is described, the remaining two or more or all of the plurality of blades 4 of the centrifugal fan 1 may be formed in the same configuration as the configuration of the predetermined blade 4.

The present disclosure is not limited to the above embodiments, and the above embodiments may be appropriately modified. Further, the above embodiments are not unrelated to each other and can be appropriately combined unless the combination is clearly impossible. Needless to say, in each of the above-described embodiments, the elements of the embodiment are not necessarily essential except when it is clearly indicated that they are essential and when they are clearly considered to be essential in principle. In each of the above embodiments, when a numerical value such as the number, numerical value, amount, range or the like of the constituent elements of the embodiment is mentioned, the present disclosure should not be limited to such a numerical value unless it is clearly stated that it is essential and/or it is required in principle. In each of the above embodiments, when the shape, the positional relationship or the like of the constituent elements of the embodiment are mentioned, the present disclosure should not be limited the shape, the positional relationship or the like unless it is clearly stated that it is essential and/or it is required in principle.

What is claimed is:

1. A centrifugal fan comprising:

a shroud that is shaped in a ring and has an air suction port at a center of the shroud;

a main plate that is opposed to the shroud and is configured to be rotated together with the shroud; and a plurality of blades that are arranged at predetermined intervals in a rotational direction between the shroud and the main plate and are joined to the shroud and the main plate, wherein:

a first tangent line is tangent to a positive pressure surface of a predetermined blade among the plurality of blades and passes through a trailing edge of the predetermined blade;

a first virtual circle is centered on a rotational axis and passes through the trailing edge of the predetermined blade, and a second tangent line is tangent to the first virtual circle and passes through the trailing edge of the predetermined blade;

the first tangent line and the second tangent line intersect at the trailing edge to define a plurality of angles in a plane perpendicular to the rotational axis, and one of the plurality of angles, which is placed in front of the first tangent line in the rotational direction and is on an outer side of the first virtual circle relative to the second tangent line, is defined as an outlet angle that changes along the trailing edge in an axial direction of the rotational axis;

when a change in the outlet angle is viewed at each of a plurality of locations axially arranged along the trailing edge, the trailing edge has at least one inflection point where an increase or decrease in the outlet angle is changed;

the outlet angle, which is measured at a corresponding adjacent one of the plurality of locations adjacent to the shroud along the trailing edge, is defined as a first outlet angle;

the outlet angle, which is measured at a corresponding one of the plurality of locations where the outlet angle is the largest among the plurality of locations axially arranged along the trailing edge, is defined as a second outlet angle;

the outlet angle, which is measured at a corresponding adjacent one of the plurality of locations adjacent to the main plate along the trailing edge, is defined as a third outlet angle; and the third outlet angle is larger than the first outlet angle, and the second outlet angle is larger than the third outlet angle.

2. The centrifugal fan according to claim 1, wherein the at least one inflection point is at least two inflection points, a connecting portion of the trailing edge, which connects between the at least two inflection points, is curved or straight.

3. The centrifugal fan according to claim 1, wherein:

a third tangent line is tangent to the positive pressure surface of the predetermined blade and passes through a predetermined position between a leading edge and the trailing edge of the predetermined blade;

a second virtual circle is centered on the rotational axis and passes through the predetermined position, and a fourth tangent line is tangent to the second virtual circle and passes through the predetermined position;

the third tangent line and the fourth tangent line intersect at the predetermined position to define a plurality of angles in the plane perpendicular to the rotational axis, and one of the plurality of angles, which is placed in front of the third tangent line in the rotational direction and is on an outer side of the second virtual circle relative to the fourth tangent line, is defined as a blade surface angle that changes in the axial direction of the rotational axis at the predetermined position along the positive pressure surface;

the blade surface angle, which is measured at a corresponding adjacent one of the plurality of locations adjacent to the shroud at a predetermined position, is defined as a first blade surface angle;

the blade surface angle, which is measured at a corresponding one of the plurality of locations where the blade surface angle is the largest among the plurality of locations axially arranged at the predetermined position, is defined as a second blade surface angle;

the blade surface angle, which is measured at a corresponding adjacent one of the plurality of locations adjacent to the main plate at the predetermined position, is defined as a third blade surface angle; and at least one of the first blade surface angle and the third blade surface angle is smaller than the second blade surface angle.

4. The centrifugal fan according to claim 3, wherein:

the outlet angle is referred to as a positive pressure surface side outlet angle;

the blade surface angle is referred to as a positive pressure surface side blade surface angle;

a fifth tangent line is tangent to a negative pressure surface of the predetermined blade and passes through the trailing edge of the predetermined blade;

a sixth tangent line is tangent to the first virtual circle and passes through the trailing edge of the predetermined blade;

the fifth tangent line and the sixth tangent line intersect at the trailing edge to define a plurality of angles in the plane perpendicular to the rotational axis, and one of the plurality of angles, which is placed in front of the fifth tangent line in the rotational direction and is on the outer side of the first virtual circle relative to the sixth tangent line, is defined as a negative pressure surface side outlet angle;

a seventh tangent line is tangent to the negative pressure surface of the predetermined blade and passes through a second predetermined position between the leading edge and the trailing edge of the predetermined blade;

a third virtual circle is centered on the rotational axis and passes through the second predetermined position, and an eighth tangent line is tangent to the third virtual circle and passes through the second predetermined position;

the seventh tangent line and the eighth tangent line intersect at the second predetermined position to define a plurality of angles in the plane perpendicular to the rotational axis, and one of the plurality of angles, which is placed in front of the seventh tangent line in the rotational direction and is on an outer side of the third virtual circle relative to the eighth tangent line, is defined as a negative pressure surface side blade surface angle; and each of the plurality of blades is shaped so that the negative pressure surface side outlet angle and the positive pressure surface side outlet angle are different from each other, and the negative pressure surface side blade surface angle and the positive pressure surface side blade surface angle are different from each other.

5. The centrifugal fan according to claim 1, wherein a distance, which is measured between the rotational axis and a portion of the trailing edge joined to the main plate, is longer than a distance, which is measured between the rotational axis and a portion of the trailing edge joined to the shroud.

6. The centrifugal fan according to claim 1, wherein the centrifugal fan is a turbofan, and at each of the plurality of blades, the trailing edge of the blade is placed behind a virtual plane that includes the rotational axis and a leading edge of the blade in the rotational direction.

7. A centrifugal fan comprising:

a shroud that is shaped in a ring and has an air suction port at a center of the shroud;

a main plate that is opposed to the shroud and is configured to be rotated together with the shroud; and a plurality of blades that are arranged at predetermined intervals in a rotational direction between the shroud and the main plate and are joined to the shroud and the main plate, wherein:

a first tangent line is tangent to a positive pressure surface of a predetermined blade among the plurality of blades and passes through a trailing edge of the predetermined blade;

a first virtual circle is centered on a rotational axis and passes through the trailing edge of the predetermined blade, and a second tangent line is tangent to the first virtual circle and passes through the trailing edge of the predetermined blade;

the first tangent line and the second tangent line intersect at the trailing edge to define a plurality of angles in a plane perpendicular to the rotational axis, and one of the plurality of angles, which is placed in front of the first tangent line in the rotational direction and is on an outer side of the first virtual circle relative to the second tangent line, is defined as an outlet angle that changes along the trailing edge in an axial direction of the rotational axis;

when a change in the outlet angle is viewed at each of a plurality of locations axially arranged along the trailing edge, the trailing edge has at least one inflection point where an increase or decrease in the outlet angle is changed;

the outlet angle, which is measured at a corresponding adjacent one of the plurality of locations adjacent to the shroud along the trailing edge, is defined as a first outlet angle;

the outlet angle, which is measured at a corresponding one of the plurality of locations where the outlet angle is the largest among the plurality of locations axially arranged along the trailing edge, is defined as a second outlet angle;

the outlet angle, which is measured at a corresponding adjacent one of the plurality of locations adjacent to the main plate along the trailing edge, is defined as a third outlet angle; and the first outlet angle is larger than the third outlet angle, and the second outlet angle is larger than the first outlet angle.

8. The centrifugal fan according to claim 7, wherein the at least one inflection point is at least two inflection points, a connecting portion of the trailing edge, which connects between the at least two inflection points, is curved or straight.

9. The centrifugal fan according to claim 7, wherein:

a third tangent line is tangent to the positive pressure surface of the predetermined blade and passes through a predetermined position between a leading edge and the trailing edge of the predetermined blade;

a second virtual circle is centered on the rotational axis and passes through the predetermined position, and a fourth tangent line is tangent to the second virtual circle and passes through the predetermined position;

the third tangent line and the fourth tangent line intersect at the predetermined position to define a plurality of angles in the plane perpendicular to the rotational axis, and one of the plurality of angles, which is placed in front of the third tangent line in the rotational direction and is on an outer side of the second virtual circle relative to the fourth tangent line, is defined as a blade surface angle that changes in the axial direction of the rotational axis at the predetermined position along the positive pressure surface;

the blade surface angle, which is measured at a corresponding adjacent one of the plurality of locations adjacent to the shroud at the predetermined position, is defined as a first blade surface angle;

the blade surface angle, which is measured at a corresponding one of the plurality of locations where the blade surface angle is the largest among the plurality of locations axially arranged at the predetermined position, is defined as a second blade surface angle;

the blade surface angle, which is measured at a corresponding adjacent one of the plurality of locations adjacent to the main plate at the predetermined position, is defined as a third blade surface angle; and at least one of the first blade surface angle and the third blade surface angle is smaller than the second blade surface angle.

10. The centrifugal fan according to claim 9, wherein:

the outlet angle is referred to as a positive pressure surface side outlet angle;

the blade surface angle is referred to as a positive pressure surface side blade surface angle;

a fifth tangent line is tangent to a negative pressure surface of the predetermined blade and passes through the trailing edge of the predetermined blade;

a sixth tangent line is tangent to the first virtual circle and passes through the trailing edge of the predetermined blade;

the fifth tangent line and the sixth tangent line intersect at the trailing edge to define a plurality of angles in the plane perpendicular to the rotational axis, and one of the plurality of angles, which is placed in front of the fifth tangent line in the rotational direction and is on the outer side of the first virtual circle relative to the sixth tangent line, is defined as a negative pressure surface side outlet angle;

a seventh tangent line is tangent to the negative pressure surface of the predetermined blade and passes through a second predetermined position between the leading edge and the trailing edge of the predetermined blade;

a third virtual circle is centered on the rotational axis and passes through the second predetermined position, and an eighth tangent line is tangent to the third virtual circle and passes through the second predetermined position;

the seventh tangent line and the eighth tangent line intersect at the second predetermined position to define a plurality of angles in the plane perpendicular to the rotational axis, and one of the plurality of angles, which is placed in front of the seventh tangent line in the rotational direction and is on an outer side of the third virtual circle relative to the eighth tangent line, is defined as a negative pressure surface side blade surface angle; and each of the plurality of blades is shaped so that the negative pressure surface side outlet angle and the positive pressure surface side outlet angle are different from each other, and the negative pressure surface side blade surface angle and the positive pressure surface side blade surface angle are different from each other.

11. The centrifugal fan according to claim 7, wherein a distance, which is measured between the rotational axis and a portion of the trailing edge joined to the main plate, is longer than a distance, which is measured between the rotational axis and a portion of the trailing edge joined to the shroud.

12. The centrifugal fan according to claim 7, wherein the centrifugal fan is a turbofan, and at each of the plurality of blades, the trailing edge of the blade is placed behind a virtual plane that includes the rotational axis and a leading edge of the blade in the rotational direction.

* * * * *